US008314057B2

(12) United States Patent
Christensen et al.

(10) Patent No.: US 8,314,057 B2
(45) Date of Patent: Nov. 20, 2012

(54) LAUNDRY COMPOSITION FOR TREATMENT OF SUNSCREEN STAINS BASED ON EXTENDED CHAIN NONIONIC SURFACTANTS

(75) Inventors: Stephen B. Christensen, Inver Grove Heights, MN (US); Joanna A. Pham, Blain, MN (US); Victor Fuk-Pong Man, St. Paul, MN (US); Michael Charles DeNoma, Vadnais Heights, MN (US); Yvonne Marie Killeen, South St. Paul, MN (US); Steven Eugene Lentsch, St. Paul, MN (US); Dawn Lock, Inver Grove Heights, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 12/884,661

(22) Filed: Sep. 17, 2010

(65) Prior Publication Data

US 2012/0071384 A1 Mar. 22, 2012

(51) Int. Cl.
*C11D 1/722* (2006.01)
*C11D 1/75* (2006.01)
*C11D 3/44* (2006.01)

(52) U.S. Cl. ..... 510/281; 510/276; 510/283; 510/289; 510/292; 510/304; 510/305; 510/333; 510/338; 510/342; 510/356; 510/432; 510/503

(58) Field of Classification Search ..... 510/276, 510/281, 283, 289, 292, 304, 305, 333, 338, 510/342, 356, 432, 503
See application file for complete search history.

(56) References Cited

U.S. PATENT DOCUMENTS

| | | | | |
|---|---|---|---|---|
| 3,871,898 | A | 3/1975 | Reinert et al. | |
| 4,492,646 | A | 1/1985 | Welch | |
| 5,082,584 | A | 1/1992 | Loth et al. | |
| 5,364,551 | A * | 11/1994 | Lentsch et al. | 510/100 |
| 5,376,310 | A | 12/1994 | Cripe et al. | |
| 5,393,468 | A | 2/1995 | Erilli et al. | |
| 5,597,507 | A | 1/1997 | Garrett et al. | |
| 5,688,930 | A | 11/1997 | Bertho et al. | |
| 5,707,948 | A | 1/1998 | Evers et al. | |
| 5,851,976 | A * | 12/1998 | Mertens | 510/365 |
| 5,888,957 | A | 3/1999 | Durbut et al. | |
| 5,922,672 | A * | 7/1999 | Stringer et al. | 510/503 |
| 5,994,283 | A | 11/1999 | Durbut et al. | |
| 6,017,872 | A * | 1/2000 | Pedersen et al. | 510/424 |
| 6,114,298 | A * | 9/2000 | Petri et al. | 510/372 |
| 6,136,769 | A | 10/2000 | Asano et al. | |
| 6,156,712 | A | 12/2000 | Stringer et al. | |
| 6,228,829 | B1 | 5/2001 | Vinson et al. | |
| 6,274,874 | B1 | 8/2001 | Sidhu | |
| 6,277,808 | B1 | 8/2001 | Tcheou et al. | |
| 6,472,364 | B1 | 10/2002 | Heltovics | |
| 6,506,261 | B1 * | 1/2003 | Man | 134/39 |
| 6,511,954 | B1 | 1/2003 | Wilbur et al. | |
| 6,589,926 | B1 | 7/2003 | Vinson et al. | |
| 6,613,726 | B1 | 9/2003 | Gagliardi et al. | |
| 6,740,627 | B1 | 5/2004 | Clarke et al. | |
| 6,827,795 | B1 | 12/2004 | Kasturi et al. | |
| 7,037,884 | B2 | 5/2006 | Man | |
| 7,467,633 | B2 | 12/2008 | Smith et al. | |
| 2001/0026942 | A1 | 10/2001 | Carpenter et al. | |
| 2002/0002125 | A1 * | 1/2002 | Colurciello, Jr. et al. | 510/238 |
| 2002/0039982 | A1 * | 4/2002 | Foley et al. | 510/218 |
| 2002/0193268 | A1 | 12/2002 | Embleton et al. | |
| 2003/0139313 | A1 | 7/2003 | Turner et al. | |
| 2004/0224867 | A1 * | 11/2004 | Colurciello et al. | 510/238 |
| 2006/0193816 | A1 * | 8/2006 | Elfersy et al. | 424/70.28 |
| 2006/0211593 | A1 | 9/2006 | Smith et al. | |
| 2007/0143032 | A1 | 6/2007 | Wieringa et al. | |
| 2008/0207981 | A1 | 8/2008 | Hoag et al. | |
| 2009/0183877 | A1 | 7/2009 | Quintero et al. | |
| 2009/0208051 | A1 | 8/2009 | Emo et al. | |
| 2009/0223635 | A1 | 9/2009 | Lawless | |
| 2009/0261270 | A1 | 10/2009 | Carling | |
| 2010/0093596 | A1 * | 4/2010 | Tadrowski | 510/365 |
| 2010/0206328 | A1 * | 8/2010 | Dreilinger et al. | 134/6 |

FOREIGN PATENT DOCUMENTS

| | | | |
|---|---|---|---|
| EP | 0368146 | A2 | 5/1990 |
| EP | 0573341 | B1 | 7/1998 |
| JP | 63073140 | A | 4/1988 |
| JP | 1100442 | A | 4/1989 |
| JP | 10292199 | A | 11/1998 |
| JP | 2001246339 | | 9/2001 |
| JP | 2009210514 | | 9/2009 |
| WO | 9732962 | | 9/1997 |
| WO | 9927054 | | 6/1999 |
| WO | 0068348 | | 11/2000 |
| WO | 2007064525 | A1 | 6/2007 |
| WO | 2007101470 | A1 | 9/2007 |
| WO | 2010086821 | A2 | 8/2010 |

OTHER PUBLICATIONS

Barber, J.A.S., et al., "Fluorescent tracer technique for measuring the quantity of pesticide deposited to soil following spray applications," Elsevier, Crop Protection 22 (2003) pp. 15-21.

(Continued)

*Primary Examiner* — Charles Boyer

(74) *Attorney, Agent, or Firm* — McKee, Voorhees & Sease, P.L.C.

(57) ABSTRACT

The invention discloses synergistic combinations of surfactants blends and cleaning composition. In certain embodiments a surfactant system is disclosed which includes extended anionic surfactants, linker surfactants, and a multiply charged cation component. This system forms emulsions with, and can remove greasy and oily stains, even those comprised of non-trans fats. In another embodiment anionic surfactants are combined with a solvent, and amine oxide to remove sunscreen stains. The compositions may be used alone, as a pre-spotter or other pre-treatment or as a part of a soft surface or hard surface cleaning composition.

7 Claims, 11 Drawing Sheets

OTHER PUBLICATIONS

Bergervoet, P.W.M., et al., "Application of the forensic Luminol for blood in infection control," Elsevier, Journal of Hospital Infection (2008) 68, pp. 329-333.
Carling, Philip C., et al., "Improved Cleaning of Patient Rooms Using a New Targeting Method," Brief Report, CID 2006:42 (Feb. 1), pp. 385-388.
Charoensaeng, Ampira, et al, "Solubilization and Adsolubilization of Polar and Nonpolar Organic Solutes by Linker Molecules and Extended Surfactants," Springer AOCS, J. Surfact. Deterg. (2009) 12, pp. 209-217.
Do, Linh D., et al., "Environmentally Friendly Vegetable Oil Microemulsions Using Extended Surfactants and Linkers," Springer AOCS, J. Surfact. Deterg. (2009) 12, pp. 91-99.
Griffith, C.J., et al. "An evaluation of hospital cleaning regimes and standards," The Hospital Infection Society, Journal of Hospital Infection (2000) 45, pp. 19-28.
Hartel, Peter G., et al., "Exposing water samples to ultraviolet light improves fluorometry for detecting human fecal contamination," Elsevier, Water Research (2007) pp. 3629-3642.
Lipscomb, I.P., et al., "Rapid method for the sensitive detection of protein contamination on surgical instruments," Elsevier, Journal of Hospital Infection (2006) 62, pp. 141-148.
Lu, Y.F., et al., "Laser surface cleaning and real-time monitoring," ALT '99 International Conference on Advanced Laser Technologies, SPIE vol. 4070 (2000), pp. 331-337.
Mori, F., et al., "Equilibrium and dynamic behavior of a system containing a mixture of anionic and nonionic surfactants," Progress in Colloid & Polymer Science (1990) 82, pp. 114-121.
Phan, Tri T., et al., "Microemulsion-Based Vegetable Oil Detergency Using an Extended Surfactant," Springer AOCS, J. Surfact. Deterg (2010) 13, pp. 313-319.
Pyrek, Kelly M., "Hospitals Can Learn from CSI Sleuthing Methods," Virgo Publishing (2011), posted on Jun. 9, 2008 at website: http://www.infectioncontroltoday.com/.
Salo, Satu, et al., "Cleaning validation of fermentation tanks," Elsevier, Food and Bioproducts Processing 86 (2008) pp. 204-210.
Wisniewski, Karen, "Specialty Liquid Household Surface Cleaners," Research & Development, Global Technology, Colgate-Palmolive Company, pp. 463-512.
Witthayapanyanon, Anuradee, et al., "Interfacial Properties of Extended-Surfactant-Based Microemulsions and Related Macroemulsions," Springer AOCS, J. Surfact. Deterg. (2010) 13, pp. 127-134.
Zhang, Hui, et al., "Lauryl Alcohol and Amine Oxide as Foam Stabilizers in the Presence of Hardness and Oily Soil," Journal of Surfactants and Detergents, vol. 8, No. 1 (Jan. 2005), pp. 99-107.
Website of "Cleanser alcohol hand rub training gel Fluroescent gel 500ml bottle with integral pump dispenser," [retrieved on Mar. 25, 2011], retrieved from the internet: https://my.supplychain.nhs.uk/catalogue/product/mrb180/cleanser-alcohol-hand-rub-training-gel.
International Search Report, PCT/US2010/049319, mailed Jun. 1, 2011.
International Search Report, PCT/US2010/049326, mailed Jun. 1, 2011.
International Search Report, PCT/US2010/049334, mailed Jun. 21, 2011.
International Search Report, PCT/US2010/049338, mailed Jun. 28, 2011.

* cited by examiner

LAUNDRY COMPOSITION FOR TREATMENT OF SUNSCREEN STAINS BASED ON EXTENDED CHAIN NONIONIC SURFACTANTS

FIELD OF THE INVENTION

The invention relates to detergent and cleaning compositions which employ synergistic combinations of detergent components and extended chain surfactants. The detergent compositions are useful for removing a number of challenging stains including those from non-trans fats, fatty acids, triglycerides, oxybenzone, and avobenzone. Additional cleaning compositions employ combinations of anionic and/or nonionic extended chain surfactants which have reduced dependence on caustics for soil removal.

BACKGROUND OF THE INVENTION

Surfactants reduce the surface tension of water by adsorbing at the liquid-gas interface. They also reduce the interfacial tension between oil and water by adsorbing at the liquid-liquid interface. Surfactants are a primary component of most detergents. When dissolved in water, surfactants give a product the ability to remove dirt from surfaces. Each surfactant molecule has a hydrophilic head that is attracted to water molecules and a hydrophobic tail that repels water and simultaneously attaches itself to oil and grease in dirt. These opposing forces loosen the dirt and suspend it in the water.

Surfactants do the basic work of detergents and cleaning compositions by breaking up stains and keeping the dirt in the water solution to prevent re-deposition of the dirt onto the surface from which it has just been removed. Surfactants disperse dirt that normally does not dissolve in water.

Nonylphenol ethoxylates (NPEs) are predominantly used as industrial and domestic detergents as a surfactant. However, while effective, NPEs are disfavored due to environmental concerns. For example, NPEs are formed through the combination of ethylene oxide with nonylphenol (NP). Both NP and NPEs exhibit estrogen-like properties and may contaminate water, vegetation and marine life. NPE is also not readily biodegradable and remains in the environment or food chain for indefinite time periods.

Continued pressure to remove NPE and other phosphates from detergents has required an increase in caustics to preserve the effectiveness of the detergent. These caustics are strong alkalis, Lye (Sodium Hydroxide), Potassium Hypochlorite, or acids which are harmful if swallowed, particularly by small children. Some symptoms include severe pain, vomiting blood, heart collapse, breathing difficulty and burns or holes in the skin and underlying tissue. While the low phosphorous detergents are better for the environment, these detergents can be up to 100 times more caustic. Caustics also damage clothes through repeated use and can dull the fabric's color.

As can be seen there is a continuing need to develop effective, environmentally friendly, and safe surfactants and surfactant systems that can be used to improve cleaning ability in cleaners of all kinds. This is particularly so in light of several new cleaning challenges that have emerged.

Consumers have drastically increased use of sunscreens in light of recommendations by medical organizations such as the American Cancer Society. Sunscreen can prevent the squamous cell carcinoma and the basal cell carcinoma which may be caused by ultraviolet radiation from the sun. Many of these sunscreens contain components such as triglycerides, avobenzones and oxybenzones. These chemicals, while not visible prior to wash, typically appear on fabrics as yellow patches after washing with detergent-builder combinations at high pH. Current methods to treat these types of stains have included bleach, and other traditional pretreatments, to no avail.

As can be seen, there is a need in the industry for improvement of cleaning compositions, such as hard surface and laundry detergents and particularly the surfactants used therein so that difficult soils can be removed in a safe environmentally friendly and effective manner.

SUMMARY OF THE INVENTION

The invention meets the needs above by providing a surfactant system, mixture or blend that can be used alone or as a part of a laundry detergent, hard surface cleaner or a pre-spotting treatment. The surfactant system is a synergistic combination of a new generation of surfactants termed extended chain surfactants. According to the invention these surfactants can be combined with other ingredients to remove very difficult stains such as those from sunscreens and can also be formulated in combinations that improve cleaning ability and thereby reduce the dependence on caustics for removal of soil. In a preferred embodiment the surfactant compositions of the invention are a synergistic combination of nonionic and anionic extended chain surfactants.

The invention has many uses and applications which include but are not limited to: laundry cleaning, reduction of laundry fire due to non-transfats, and hard surface cleaning such as manual pot-n-pan cleaning, machine warewashing, all purpose cleaning, floor cleaning, CIP cleaning, open facility cleaning, foam cleaning, vehicle cleaning, etc. The invention is also relevant to non-cleaning related uses and applications such as dry lubes, tire dressings, polishes, etc. as well as triglyceride based lotions, suntan lotions, potentially pharmaceutical emulsions and microemulsions.

The surfactant system comprises anionic and/or nonionic extended chain surfactants. Interestingly, applicants have found that the soil removal is proportional to the degree of PO extension of the linker of the extended chain surfactant. The use of extended surfactants shifts the required optimal alkalinity to a significantly lower level. This can result in cost savings, use of a less aggressive composition for better user safety, less fabric damage, and less corrosion due to alkalinity. This system can be used in formulations for laundry detergents, hard surface cleaners, whether alkali or acid based or even by itself as a pre-spotting agent.

In yet another aspect of the invention a laundry booster is provided which comprises a synergistic combination of an extended chain surfactant, a solvent and amine oxide. The booster is particularly suited to removal of stains caused by sunscreen components such as triglycerides, oxybenzone and avobenzone.

In a further aspect of the present invention, a laundry detergent composition is provided which includes the surfactant system within a laundry detergent, the laundry detergent product being adapted to readily dissolve and disperse non trans fats and sunscreen components in commercial, industrial and personal laundry washing processes or in a pre-spotting treatment, as well as detergents that are less caustic.

These and other objects, features and attendant advantages of the present invention will become apparent to those skilled in the art from a reading of the following detailed description of the preferred embodiment and the appended claims.

DETAILED DESCRIPTION OF THE INVENTION

Figure 1:
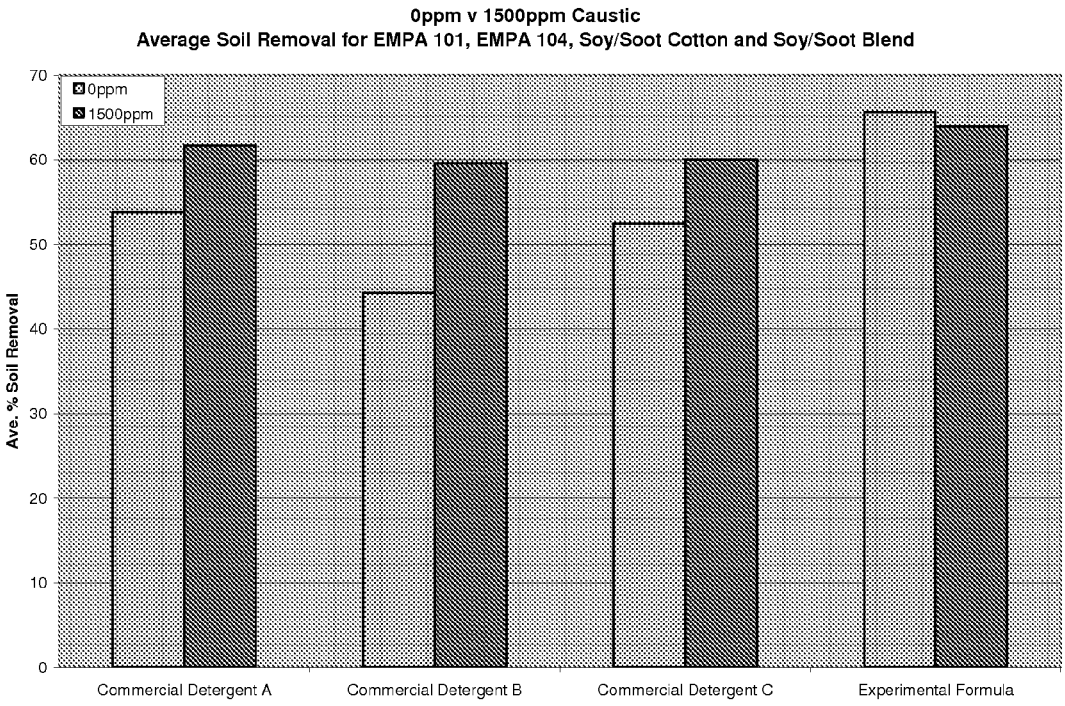
FIG. 1 is a graph of 0 ppm and 1500 ppm caustic and average soils removal for several laundry detergents and a detergent of the invention.

So that the invention maybe more readily understood, certain terms are first defined and certain test methods are described.

As used herein, the term "caustic-free" refers to a composition, mixture, or ingredient that does not contain strong alkalis, such as lye (Sodium Hydroxide), Potassium Hypochlorite or source of alkalinity typically present in a builder including but not limited to alkali metal citrates, succinates, malonates, carboxymethyl succinates, carboxylates, polycarboxylates and polyacetyl carboxylate; or sodium, potassium and lithium salts of oxydisuccinic acid, mellitic acid, benzene polycarboxylic acids, and citric acid; or citric acid and citrate salts, organic phosphonate type sequestering agents, alkanehydroxy phosphonates, polyacrylic acid, polymaleic acid, and polyacrylic/polymaleic acid copolymers and their salts.

The reference to "cleaning" refers to at least one of the removal of soil, the removal of staining or the appearance of staining, and/or the reduction of a population of microbes. A cleaning process can include all three of the removal of soil, the removal of staining or the appearance of staining, and the reduction of a population of microbes. In other embodiments, a cleaning process can include any one of the removal of soil, the removal of staining or the appearance of staining, or the reduction of a population of microbes. In yet other embodiments, a cleaning process can include any combination of the removal of soil, the removal of staining or the appearance of staining, and the reduction of a population of microbes.

All numeric values are herein assumed to be modified by the term "about," whether or not explicitly indicated. The term "about" generally refers to a range of numbers that one of skill in the art would consider equivalent to the recited value (i.e., having the same function or result). In many instances, the term "about" may include numbers that are rounded to the nearest significant figure.

Weight percent, percent by weight, % by weight, wt %, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4 and 5).

As used in this specification and the appended claims, the singular forms "a," "an," and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "surfactant" as used herein is a compound that contains a lipophilic segment and a hydrophilic segment, which when added to water or solvents, reduces the surface tension of the system.

An "extended chain surfactant" is a surfactant having an intermediate polarity linking chain, such as a block of polypropylene oxide, or a block of poly-ethylene oxide, or a block of poly-butylene oxide or a mixture thereof inserted between the surfactant's conventional lipophilic segment and hydrophilic segment.

The term "electrolyte" refers to a substance that will provide ionic conductivity when dissolved in water or when in contact with it; such compounds may either be solid or liquid.

As used herein, the term "microemulsion" refers to thermodynamically stable, isotropic dispersions consisting of nanometer size domains of water and/or oil stabilized by an interfacial film of surface active agent characterized by ultra low interfacial tension.

The term "hard surface" refers to a solid, substantially non-flexible surface such as a counter top, tile, floor, wall, panel, window, plumbing fixture, kitchen and bathroom furniture, appliance, engine, circuit board, and dish.

The term "soft surface" refers to a softer, highly flexible material such as fabric, carpet, hair, and skin.

"Soil" or "stain" refers to a non-polar oily substance which may or may not contain particulate matter such as mineral clays, sand, natural mineral matter, carbon black, graphite, kaolin, environmental dust, etc.

As used herein, the term "cleaning composition" includes, unless otherwise indicated, detergent compositions, laundry cleaning compositions, hard surface cleaning compositions, and personal care cleaning compositions for use in the health and beauty area. Cleaning compositions include granular, powder, liquid, gel, paste, bar form and/or flake type cleaning agents, laundry detergent cleaning agents, laundry soak or spray treatments, fabric treatment compositions, dish washing detergents and soaps, shampoos, body washes and soaps, and other similar cleaning compositions. As used herein, the term "fabric treatment composition" includes, unless otherwise indicated, fabric softening compositions, fabric enhancing compositions, fabric freshening compositions and combinations there of. Such compositions may be, but need not be rinse added compositions.

The term "laundry" refers to items or articles that are cleaned in a laundry washing machine. In general, laundry refers to any item or article made from or including textile materials, woven fabrics, non-woven fabrics, and knitted fabrics. The textile materials can include natural or synthetic fibers such as silk fibers, linen fibers, cotton fibers, polyester fibers, polyamide fibers such as nylon, acrylic fibers, acetate fibers, and blends thereof including cotton and polyester blends. The fibers can be treated or untreated. Exemplary treated fibers include those treated for flame retardancy. It should be understood that the term "linen" is often used to describe certain types of laundry items including bed sheets, pillow cases, towels, table linen, table cloth, bar mops and uniforms. The invention additionally provides a composition and method for treating non-laundry articles and surfaces including hard surfaces such as dishes, glasses, and other ware.

The term "reduced caustic" or "reduced alkalinity" in reference to a detergent shall mean a detergent with cleaning performance that is not dependant significantly on presence of caustic, i.e. the addition of caustic will not substantially improve cleaning performance.

Surfactant Systems Employing Extended Chain Surfactants

The surfactant system or mixture of the invention employs one or more extended chain surfactants. These are surfactants that have a linker, such as an intermediate polarity polypropylene oxide chain, inserted between the lipophilic tail group and hydrophilic polar head, which may be anionic or nonionic.

Examples of lipophilic tail groups include hydrocarbons, alkyl ether, fluorocarbons or siloxanes. Examples of anionic and nonionic hydrophilic polar heads of the extended surfactant include, but are not necessarily limited to, groups such as polyoxyethylene sulfate, ethoxysulfate, carboxylate, ethoxycarboxylate, C6 sugar, xylitol, di-xylitol, ethoxy-xylitol, carboxylate and xytol, carboxylate and glucose.

Extended surfactants include a linker polypropylene glycol link.

The general formula for a nonionic extended surfactant is $R—[L]_x-[O—CH_2—CH_2]_y$.

Where R is the lipophilic moiety, a linear or branched, saturated or unsaturated, substituted or unsubstituted, aliphatic or aromatic hydrocarbon radical having from about 8 to 20 carbon atoms, L is a linking group, such as a block of polypropylene oxide, a block of poly-ethylene oxide, a block of poly-butylene oxide or a mixture thereof; x is the chain length of the linking group ranging from 5-15; and y is the average degree of ethoxylation ranging from 1-5.

Anionic extended surfactants generally have the formula $$R—[L]_x-[O—CH_2—CH_2]_y-M$$

Where M is any ionic species such as carboxylates, sulfonates, sulfates, and phosphates. A cationic species will generally also be present for charge neutrality such as hydrogen, an alkali metal, alkaline earth metal, ammonium and ammonium ions which may be substituted with one or more organic groups These extended chain surfactants attain low tension and/or high solubilization in a single phase microemulsion with oils, such as nontrans fats with additional beneficial properties including, but not necessarily limited to, insensitivity to temperature and irreversibility. For example, in one embodiment the emulsions may function over a relatively wide temperature range of from about 20 to about 280° C., alternatively from about 20 to about 180° C. (350° F.).

Many extended chain anionic and nonionic surfactants are commercially available from a number of sources. Table 1 is a representative, nonlimiting listing of several examples of the same.

TABLE 1

| Extended Surfactants | Source | % Active | Structure |
|---|---|---|---|
| Plurafac SL-42 (nonionic) | BASF | 100 | $C_{6-10}—(PO)_3(EO)_6$ |
| Plurafac SL-62 (nonionic) | BASF | 100 | $C_{6-10}—(PO)_3(EO)_8$ |
| Lutensol XL-40 (nonionic) | BASF | 100 | $C_{10}—(PO)_a(EO)_b$ series, where a |
| Lutensol XL-50 (nonionic) | BASF | 100 | is 1.0 to 1.5, and b is 4 to 14. |
| Lutensol XL-60 (nonionic) | BASF | 100 | |
| Lutensol XL-70 (nonionic) | BASF | 100 | |
| Lutensol XL-79 (nonionic) | BASF | 85 | |
| Lutensol XL-80 (nonionic) | BASF | 100 | |
| Lutensol XL-89 (nonionic) | BASF | 80 | |
| Lutensol XL-90 (nonionic) | BASF | 100 | |
| Lutensol XL-99 (nonionic) | BASF | 80 | |
| Lutensol XL-100 (nonionic) | BASF | 100 | |
| Lutensol XL-140 (nonionic) | BASF | 100 | |
| Ecosurf EH-3 (nonionic) | Dow | 100 | 2-Ethyl Hexyl $(PO)_m(EO)_n$ |
| Ecosurf EH-6 (nonionic) | Dow | 100 | series |
| Ecosurf EH-9 (nonionic) | Dow | 100 | |
| Ecosurf SA-4 (nonionic) | Dow | 100 | $C_{6-12}(PO)_{3-4}(EO)_4$ |
| Ecosurf SA-7 (nonionic) | Dow | 100 | $C_{6-12}(PO)_{3-4}(EO)_7$ |
| Ecosurf SA-9 (nonionic) | Dow | 100 | $C_{6-12}(PO)_{3-4}(EO)_9$ |
| Surfonic PEA-25 (nonionic) | Huntsman | 100 | $C_{12-14}(PO)_2N[(EO)_{2.5}\}_2$ |
| X-AES (anionic) | Huntsman | 23 | $C_{12-14}—(PO)_{16}-(EO)_2$-sulfate |
| X-LAE (nonionic) | Huntsman | 100 | $C_{12-14}—(PO)_{16}(EO)_{12}$ |
| Alfoterra 123-4S (anionic) | Sasol | 30 | $C_{12-13}—(PO)_4$-sulfate |
| Alfoterra 123-8S (anionic) | Sasol | 30 | $C_{12-13}—(PO)_8$-sulfate |
| Marlowet 4561 (nonionic under acidic condition, anionic under alkaline condition) | Sasol | 90 | $C_{16-18}(PO)_4(EO)_5$-carboxylic acid |
| Marlowet 4560 (nonionic under acidic condition, anionic under alkaline condition) | Sasol | 90 | $C_{16-18}(PO)_4(EO)_2$-carboxylic acid |
| Marlowet 4539 (nonionic under acidic condition, anionic under alkaline condition) | Sasol | 90 | Iso $C_9—(PO)_2EO_2$-carboxylic acid |

According to the invention, these extended chain surfactants can be formulated in detergents that rely less on caustics for their cleaning ability. In some formulations a linker surfactant may be used, particularly with nonionic extended chain surfactants. The linker cosurfactant is an additive which "sticks to" or "associates with" the extended chain nonionic surfactant and links it with the molecules in the bulk phase, and hence increase the "reach" of the surfactant molecules which are adsorbed at interface, thus enhancing their performance. Linker co-surfactants which may be used according to the invention include mono- and di-glycerides, and/or fatty acids and fatty diacids. Suitable fatty acids are saturated and/or unsaturated and can be obtained from natural sources such a plant or animal esters (e.g., palm kernel oil, palm oil, coconut oil, babassu oil, safflower oil, tall oil, tallow and fish oils, grease, and mixtures thereof), or synthetically prepared (e.g., via the oxidation of petroleum or by hydrogenation of carbon monoxide via the Fisher Tropsch process). Useful fatty acids are saturated $C_{12}$ fatty acid, saturated $C_{12-14}$ fatty acids, saturated or unsaturated $C_{12-18}$ fatty acids, and a mixture thereof. Examples of suitable saturated fatty acids include captic, lauric, myristic, palmitic, stearic, arachidic and behenic acid. Suitable unsaturated fatty acids include: palmitoleic, oleic, linoleic, linolenic and ricinoleic acid.

In a preferred embodiment a combination of nonionic and anionic extended surfactants may be used.

According to the invention, traditional builders, which rely on a source of alkalinity are greatly reduced or even eliminated entirely with similar cleaning. Thus, the invention includes an effective amount of a surfactant system employing one or more extended chain surfactants.

The amounts of the components are not critical and can be adjusted to maximize the planar surface of the surfactant system and the desired soils to be cleaned. While not wishing to be bound by any theory, applicants postulate that the beneficial use of surfactants with a balanced cross-sectional area, for example surfactants with a small hydrophilic head and/or surfactants with twin or bulky hydrophobic tail(s) help the overall packing at the water and oil interface towards a more planar interface. Other possible linkers with balanced cross sectional areas include branched alcohol ethoxylates and Guerbet alcohol ethoxylates. The multiple charge cations, especially $Mg^{2+}$, compress the effective sizes of the hydrophilic head, further helping the overall packing towards a planar interface. Alternatively, alkalinity may be used for this purpose as explained herein. Alkalinity provides other benefits such as dissolving polymerized grease.

According to the invention, the surfactant system contains an effective amount of an extended chain surfactant. In a preferred embodiment, the embodiment contains a synergistic combination that includes an extended chain nonionic surfactant and an extended chain anionic surfactant. In a preferred embodiment the combination includes a ratio of nonionic to anionic extended chain surfactant of greater than 1:1 weight percent ration. In a more preferred embodiment the ration if 2:1 nonionic to anionic, even more preferred is approximately 4:1 weight percent ratio.

In another embodiment of the invention, surfactant system of the invention may be used as a booster composition for removal of other difficult soils including those caused by the ingredients found in many sunscreens. According to the invention extended chain surfactants, particularly nonionic extended chain surfactants, may be combined synergistically with solvents and amine oxide. The resulting booster composition is more effective at removing stains caused by components of sunscreens such as avobenzone and oxybenzone. These stains are not visible until after drying and result in a yellow colored stain on resulting towels, sheets, and the like. In a preferred embodiment, the booster compositions comprise from about 50-70% by weight of an extended chain nonionic surfactant, from about 1-20% of an extended chain anionic surfactant, from about 10-40% solvent and about 1-15% amine oxide. Solvents useful for the present invention include polyethylene oxide ethers derived from lauryl alcohol, cetyl alcohol, oleyl alcohol, stearyl alcohol, isostearyl alcohol, myristyl alcohol, behenyl alcohol, and mixtures thereof. In addition, polyoxyethylene 10 cetyl ether, known by the CTFA designation as ceteth-10; polyoxyethylene stearyl ether, known by the CTFA designation steareth-21; coconut alkyl polyethoxylate; decyl polyethoxylate, ethoxylates of nonylphenol, dinonylphenol, dodecylphenol, dodecyl alcohol or sorbitan lauryl esters ethoxylated with 20 EO groups and mixtures thereof may also be used. Particularly preferred are butyl carbitol and/or propylene-glycol-phenyl-ether. The surfactant booster system is preferably a mixture of both noninonic and anionic surfactants. Such composition may be used as a pre-spotter, or a booster in combination with a detergent or incorporated directly into the detergent compositions. One example of a booster surfactant composition according to the invention is listed below:

| | Amount (%) |
|---|---|
| Ecosurf SA9 | 28 |
| Ecosurf SA4 | 22 |
| Marlowet 4539 LF | 10 |
| Butyl Carbitol | 14.75 |
| PPH | 14.75 |
| Barlox 12 | 5 |
| LAS | 5 |
| Momentive Y-14865 silicone antifoam | 0.5 |

Cleaning Compositions Comprising Extended Chain Surfactants

The booster or surfactant system of the invention may be used alone, as a pre-spot or pre-treatment composition in combination with a traditional detergent or cleaner, or may be incorporated within a cleaning composition. The invention comprises both hard surface and soft surface cleaning compositions employing the disclosed surfactant and/or booster system.

In one embodiment, the invention employs the surfactant system of the invention, an acid source, a solvent, a water conditioning agent, and water to make a hard surface cleaner which will be effective at removing greasy and oily soils from surfaces such as showers, sinks, toilets, bathtubs, countertops, windows, minors, transportation vehicles, floors, and the like. These surfaces can be those typified as "hard surfaces" (such as walls, floors, bed-pans).

A typical hard surface formulation at about 18% activity includes between about 40 wt. % and about 80 wt. % surfactant system of the invention, between about 3 wt. % and about 18 wt. % water conditioning agent, between about 0.1 wt. % and about 0.55 wt. % acid source, between about 0 wt % and about 10 wt. % solvent and between about 10 wt. % and about 60 wt. % water. Particularly, the cleaning compositions include between about 45 wt. % and about 75 wt. % surfactant system of the invention, between about 0 wt. % and about 10 wt. % optional co-surfactant, between about 5 wt. % and about 15 wt. % water conditioning agent, between about 0.3 wt. % and about 0.5 wt. % acid source, between about 0 and about 6 wt. % solvent and between about 15 wt. % and about 50 wt. % water. In other embodiments, similar intermediate concentrations and use concentrations may also be present in the cleaning compositions of the invention.

In a laundry detergent formulation the compositions of the invention typically include the surfactant system of the invention, and a builder, optionally with an enzyme. Examples of such standard laundry detergent ingredients, which are well known to those skilled in the art, are provided in the following paragraphs.

Additional Components

While not essential for the purposes of the present invention, the non-limiting list of additional components illustrated hereinafter are suitable for use in the instant compositions and may be desirably incorporated in certain embodiments of the invention, for example to assist or enhance cleaning performance, for treatment of the substrate to be cleaned, or to modify the aesthetics of the cleaning composition as is the case with perfumes, colorants, dyes or the like. The precise nature of these additional components, and levels of incorporation thereof, will depend on the physical form of the composition and the nature of the cleaning operation for which it is to be used. Suitable additional materials include, but are not limited to, surfactants, builders, chelating agents, dye transfer inhibiting agents, viscosity modifiers, dispersants, additional enzymes, and enzyme stabilizers, catalytic materials, bleaches, bleach activators, hydrogen peroxide, sources of hydrogen peroxide, preformed peracids, polymeric dispersing agents, threshold inhibitors for hard water precipitation pigments, clay soil removal/anti-redeposition agents, brighteners, suds suppressors, dyes, fabric hueing agents, perfumes, structure elasticizing agents, fabric softeners, carriers, hydrotropes, processing aids, solvents, pigments antimicrobials, pH buffers, processing aids, active fluorescent whitening ingredient, additional surfactants and mixtures thereof. In addition to the disclosure below, suitable examples of such other adjuncts and levels of use are found in U.S. Pat. Nos. 5,576,282, 6,306,812 B1 and 6,326,348 B1 that are incorporated by reference.

As stated, the adjunct ingredients are not essential to Applicants' compositions. Thus, certain embodiments of Applicants' compositions do not contain additional materials. However, when one or more additional materials are present, such one or more additional components may be present as detailed below:

The liquid detergent herein has a neat pH of from about 7 to about 13, or about 7 to about 9, or from about 7.2 to about 8.5, or from about 7.4 to about 8.2. The detergent may contain a buffer and/or a pH-adjusting agent, including inorganic and/or organic alkalinity sources and acidifying agents such as water-soluble alkali metal, and/or alkali earth metal salts of hydroxides, oxides, carbonates, bicarbonates, borates, silicates, phosphates, and/or metasilicates; or sodium hydroxide, potassium hydroxide, pyrophosphate, orthophosphate, polyphosphate, and/or phosphonate. The organic alkalinity source herein includes a primary, secondary, and/or tertiary amine. The inorganic acidifying agent herein includes HF, HCl, HBr, HI, boric acid, sulfuric acid, phosphoric acid, and/or sulphonic acid; or boric acid. The organic acidifying agent herein includes substituted and substituted, branched, linear and/or cyclic $C_{1-30}$ carboxylic acid.

Bleaching Agents—The cleaning compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent by weight of the subject cleaning composition. Examples of suitable bleaching agents include: (1) preformed peracids: Suitable preformed peracids include, but are not limited to, compounds selected from the group consisting of percarboxylic acids and salts, percarbonic acids and salts, perimidic acids and salts, peroxymonosulfuric acids and salts, for example, Oxzone®, and mixtures thereof. Suitable percarboxylic acids include hydrophobic and hydrophilic peracids having the formula R—(C—O)O—O-M wherein R is an alkyl group, optionally branched, having, when the peracid is hydrophobic, from 6 to 14 carbon atoms, or from 8 to 12 carbon atoms and, when the peracid is hydrophilic, less than 6 carbon atoms or even less than 4 carbon atoms; and M is a counterion, for example, sodium, potassium or hydrogen; (2) sources of hydrogen peroxide, for example, inorganic perhydrate salts, including alkali metal salts such as sodium salts of perborate (usually mono- or tetra-hydrate), percarbonate, persulphate, perphosphate, persilicate salts and mixtures thereof. In one aspect of the invention the inorganic perhydrate salts are selected from the group consisting of sodium salts of perborate, percarbonate and mixtures thereof. When employed, inorganic perhydrate salts are typically present in amounts of from 0.05 to 40 wt %, or 1 to 30 wt % of the overall composition and are typically incorporated into such compositions as a crystalline solid that may be coated. Suitable coatings include, inorganic salts such as alkali metal silicate, carbonate or borate salts or mixtures thereof, or organic materials such as water-soluble or dispersible polymers, waxes, oils or fatty soaps; and (3) bleach activators having R—(C—O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS). Suitable bleach activators are also disclosed in WO 98/17767. While any suitable bleach activator may be employed, in one aspect of the invention the subject cleaning composition may comprise NOBS, TAED or mixtures thereof.

When present, the peracid and/or bleach activator is generally present in the composition in an amount of from about 0.1 to about 60 wt %, from about 0.5 to about 40 wt % or even from about 0.6 to about 10 wt % based on the composition. One or more hydrophobic peracids or precursors thereof may be used in combination with one or more hydrophilic peracid or precursor thereof.

The amounts of hydrogen peroxide source and peracid or bleach activator may be selected such that the molar ratio of available oxygen (from the peroxide source) to peracid is from 1:1 to 35:1, or even 2:1 to 10:1.

Additional Surfactant

In some embodiments, the compositions of the invention include an additional surfactant. Additional surfactants can be anionic, nonionic, cationic zwitterionic and can also include additional extended chain surfactant as discussed herein.

The cleaning composition can contain an additional anionic surfactant component that includes a detersive amount of an anionic surfactant or a mixture of anionic surfactants. Anionic surfactants are desirable in cleaning compositions because of their wetting and detersive properties.

The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the cleaning composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the cleaning composition include those having between about 1 and about 10 repeating alkoxy groups, between about 1 and about 5 repeating alkoxy groups. In general, the alkoxy group will contain between about 2 and about 4 carbon atoms. A suitable alkoxy group is ethoxy. A suitable alkyl ether sulfate is sodium lauryl ether sulfate and is available under the name Steol CS-460.

Suitable alkyl sulfates that can be used in the cleaning composition include those having an alkyl group containing 6 to 24 carbon atoms. Suitable alkyl sulfates include, but are not limited to, sodium lauryl sulfate and sodium lauryl/myristyl sulfate.

Suitable alcohol sulfates that can be used in the cleaning composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

The cleaning composition, when provided as a concentrate, can include the additional anionic surfactant component in an amount sufficient to provide a use composition having desired wetting and detersive properties after dilution with water. The concentrate can contain about 0.1 wt. % to about 0.5 wt. %, about 0.1 wt. % to about 1.0 wt. %, about 1.0 wt. % to about 5 wt. %, about 5 wt. % to about 10 wt. %, about 10 wt. % to about 20 wt. %, 30 wt. %, about 0.5 wt. % to about 25 wt. %, and about 1 wt. % to about 15 wt. %, and similar intermediate concentrations of the anionic surfactant.

The cleaning composition can contain a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the detergent composition.

Additional nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt %.

Other nonionic surfactants include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include alkylphenol ethoxylates, branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauric diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, phosphate esters, alcohol phosphate, fatty triglycerides, fatty triglyceride esters, alkyl ether phosphate, alkyl esters, alkyl phenol ethoxylate phosphate esters, alkyl polysaccharides, block copolymers, alkyl polyglucosides, or mixtures thereof.

When nonionic surfactants are included in the detergent composition concentrate, they can be included in an amount of at least about 0.1 wt. % and can be included in an amount of up to about 15 wt. %. The concentrate can include about 0.1 to 1.0 wt. %, about 0.5 wt. % to about 12 wt. % or about 2 wt. % to about 10 wt. % of the nonionic surfactant.

Amphoteric surfactants can also be used to provide desired detersive properties. Suitable amphoteric surfactants that can be used include, but are not limited to: betaines, imidazolines, and propionates. Suitable amphoteric surfactants include, but are not limited to: sultaines, amphopropionates, amphodipropionates, aminopropionates, aminodipropionates, amphoacetates, amphodiacetates, and amphohydroxypropylsulfonates.

When the detergent composition includes an amphoteric surfactant, the amphoteric surfactant can be included in an amount of about 0.1 wt % to about 15 wt %. The concentrate can include about 0.1 wt % to about 1.0 wt %, 0.5 wt % to about 12 wt % or about 2 wt % to about 10 wt % of the amphoteric surfactant.

The cleaning composition can contain a cationic surfactant component that includes a detersive amount of cationic surfactant or a mixture of cationic surfactants. Cationic co-surfactants that can be used in the cleaning composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$) dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

Builders—The cleaning compositions of the present invention may comprise one or more detergent builders or builder systems. When a builder is used, the subject composition will typically comprise at least about 1%, from about 5% to about 60% or even from about 10% to about 40% builder by weight of the subject composition. The detergent may contain an inorganic or organic detergent builder which counteracts the effects of calcium, or other ion, water hardness. Examples include the alkali metal citrates, succinates, malonates, carboxymethyl succinates, carboxylates, polycarboxylates and polyacetyl carboxylate; or sodium, potassium and lithium salts of oxydisuccinic acid, mellitic acid, benzene polycarboxylic acids, and citric acid; or citric acid and citrate salts. Organic phosphonate type sequestering agents such as DEQUEST® by Monsanto and alkanehydroxy phosphonates are useful. Other organic builders include higher molecular weight polymers and copolymers, e.g., polyacrylic acid, polymaleic acid, and polyacrylic/polymaleic acid copolymers and their salts, such as SOKALAN® by BASF. Generally, the builder may be up to 30%, or from about 1% to about 20%, or from abut 3% to about 10%.

The compositions may also contain from about 0.01% to about 10%, or from about 2% to about 7%, or from about 3% to about 5% of a $C_{8-20}$ fatty acid as a builder. The fatty acid can also contain from about 1 to about 10 EO units. Suitable fatty acids are saturated and/or unsaturated and can be obtained from natural sources such a plant or animal esters (e.g., palm kernel oil, palm oil, coconut oil, babassu oil, safflower oil, tall oil, tallow and fish oils, grease, and mixtures thereof), or synthetically prepared (e.g., via the oxidation of petroleum or by hydrogenation of carbon monoxide via the Fisher Tropsch process). Useful fatty acids are saturated $C_{12}$ fatty acid, saturated $C_{12-14}$ fatty acids, saturated or unsaturated $C_{12-18}$ fatty acids, and a mixture thereof. Examples of suitable saturated fatty acids include captic, lauric, myristic, palmitic, stearic, arachidic and behenic acid. Suitable unsaturated fatty acids include: palmitoleic, oleic, linoleic, linolenic and ricinoleic acid.

Chelating Agents—The cleaning compositions herein may contain a chelating agent. Suitable chelating agents include copper, iron and/or manganese chelating agents and mixtures thereof. When a chelating agent is used, the subject composition may comprise from about 0.005% to about 15% or even from about 3.0% to about 10% chelating agent by weight of the subject composition.

Dye Transfer Inhibiting Agents—The cleaning compositions of the present invention may also include one or more dye transfer inhibiting agents. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. When present in a subject composition, the dye transfer inhibiting agents may be present at levels from about 0.0001% to about 10%, from about 0.01% to about 5% or even from about 0.1% to about 3% by weight of the composition.

Optical Brightener

In some embodiments, an optical brightener component, may be present in the compositions of the present invention. The optical brightener can include any brightener that is capable of eliminating graying and yellowing of fabrics. Typically, these substances attach to the fibers and bring about a brightening and simulated bleaching action by converting invisible ultraviolet radiation into visible longer-wave length light, the ultraviolet light absorbed from sunlight being irradiated as a pale bluish fluorescence and, together with the yellow shade of the grayed or yellowed laundry, producing pure white.

Fluorescent compounds belonging to the optical brightener family are typically aromatic or aromatic heterocyclic materials often containing condensed ring systems. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.).

Optical brighteners useful in the present invention are known and commercially available. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene. In an embodiment, optical brighteners include stilbene derivatives.

In some embodiments, the optical brightener includes Tinopal UNPA, which is commercially available through the Ciba Geigy Corporation located in Switzerland.

Additional optical brighteners for use in the present invention include, but are not limited to, the classes of substance of 4,4'-diamino-2,2'-stilbenedisulfonic acids (flavonic acids), 4,4'-distyrylbiphenyls, methylumbelliferones, coumarins, dihydroquinolinones, 1,3-diarylpyrazolines, naphthalimides, benzoxazol, benzisoxazol and benzimidazol systems, and pyrene derivatives substituted by heterocycles, and the like. Suitable optical brightener levels include lower levels of from about 0.01, from about 0.05, from about 0.1 or even from about 0.2 wt % to upper levels of 0.5 or even 0.75 wt %.

Dispersants—The compositions of the present invention can also contain dispersants. Suitable water-soluble organic materials include the homo- or co-polymeric acids or their salts, in which the polycarboxylic acid comprises at least two carboxyl radicals separated from each other by not more than two carbon atoms.

Additional Enzymes—The cleaning compositions can comprise one or more enzymes which provide cleaning performance and/or fabric care benefits. Enzymes can be included herein for a wide variety of fabric laundering purposes, including removal of protein-based, carbohydratebased, or triglyceride-based stains, for example, and/or for fabric restoration. Examples of suitable enzymes include, but are not limited to, hemicellulases, peroxidases, proteases, cellulases, xylanases, lipases, phospholipases, esterases, cutinases, pectinases, keratinases, reductases, oxidases, phenoloxidases, lipoxygenases, ligninases, pullulanases, tannases, pentosanases, malanases, β-glucanases, arabinosidases, hyaluronidase, chondroitinase, laccase, amylases, or combinations thereof and may be of any suitable origin. The choice of enzyme(s) takes into account factors such as pH-activity, stability optima, thermostability, stability versus active detergents, chelants, builders, etc. A detersive enzyme mixture useful herein is a protease, lipase, cutinase and/or cellulase in conjunction with amylase. Sample detersive enzymes are described in U.S. Pat. No. 6,579,839.

Enzymes are normally present at up to about 5 mg, more typically from about 0.01 mg to about 3 mg by weight of active enzyme per gram of the detergent. Stated another way, the detergent herein will typically contain from about 0.001% to about 5%, or from about 0.01% to about 2%, or from about 0.05% to about 1% by weight of a commercial enzyme preparation. Protease enzymes are present at from about 0.005 to about 0.1 AU of activity per gram of detergent. Proteases useful herein include those like subtilisins from *Bacillus* [e.g. subtilis, lentus, lichenifonnis, amyloliquefaciens (BPN, BPN'), alcalophilus,] e.g. Esperase®, Alcalase®, Everlase® and Savinase® (Novozymes), BLAP and variants (Henkel). Further proteases are described in EP 130756, WO 91/06637, WO 95/10591 and WO 99/20726.

Amylases are described in GB Pat. #1 296 839, WO 94/02597 and WO 96/23873; and available as Purafect Ox Am® (Genencor), Termamyl®, Natalase®, Ban®, Fungamyl®, Duramyl® (all Novozymes), and RAPIDASE (International Bio-Synthetics, Inc).

The cellulase herein includes bacterial and/or fungal cellulases with a pH optimum between 5 and 9.5. Suitable cellulases are disclosed in U.S. Pat. No. 4,435,307 to Barbesgoard, et al., issued Mar. 6, 1984. Cellulases useful herein include bacterial or fungal cellulases, e.g. produced by *Humicola insolens*, particularly DSM 1800, e.g. 50 kD and ~43 kD (Carezyyme®). Additional suitable cellulases are the EGIII cellulases from *Trichoderma longibrachiatum*. WO 02/099091 by Novozymes describes an enzyme exhibiting endo-beta-glucanase activity (EC 3.2.1.4) endogenous to *Bacillus* sp., DSM 12648; for use in detergent and textile applications; and an anti-redeposition endo-glucanase in WO 04/053039. Kao's EP 265 832 describes alkaline cellulase K, CMCase I and CMCase II isolated from a culture product of *Bacillus* sp KSM-635. Kao further describes in EP 1 350 843 (KSM 5237; 1139; KSM 64; KSM N131), EP 265 832A (KSM 635, FERM BP 1485) and EP 0 271 044 A (KSM 534, FERM BP 1508; KSM 539, FERM BP 1509; KSM 577, FERM BP 1510; KSM 521, FERM BP 1507; KSM 580, FERM BP 1511; KSM 588, FERM BP 1513; KSM 597, FERM BP 1514; KSM 522, FERM BP 1512; KSM 3445, FERM BP 1506; KSM 425. FERM BP 1505) readily-mass producible and high activity alkaline cellulases/endo-glucanases for an alkaline environment. Such endo-glucanase may contain a polypeptide (or variant thereof) endogenous to one of the above *Bacillus* species. Other suitable cellulases are Family 44 Glycosyl Hydrolase enzymes exhibiting endo-beta-1,4-glucanase activity from Paenibacilus polyxyma (wild-type) such as XYG1006 described in WO 01/062903 or variants thereof. Carbohydrases useful herein include e.g. mannanase (see, e.g., U.S. Pat. No. 6,060,299), pectate lyase (see, e.g., WO99/27083), cyclomaltodextrin glucanotransferase (see, e.g., WO96/33267), and/or xyloglucanase (see, e.g., WO99/02663). Bleaching enzymes useful herein with enhancers include e.g. peroxidases, laccases, oxygenases, lipoxygenase (see, e.g., WO 95/26393), and/or (non-heme) haloperoxidases.

Suitable endoglucanases include: 1) An enzyme exhibiting endo-beta-1,4-glucanase activity (E.C. 3.2.1.4), with a sequence at least 90%, or at least 94%, or at least 97% or at least 99%, or 100% identity to the amino acid sequence of positions 1-773 of SEQ ID NO:2 in WO 02/099091; or a fragment thereof that has endo-beta-1,4-glucanase activity. GAP in the GCG program determines identity using a GAP creation penalty of 3.0 and GAP extension penalty of 0.1. See WO 02/099091 by Novozymes A/S on Dec. 12, 2002, e.g., Celluclean™ by Novozymes A/S. GCG refers to sequence analysis software package (Accelrys, San Diego, Calif., USA). GCG includes a program called GAP which uses the Needleman and Wunsch algorithm to find the alignment of two complete sequences that maximizes the number of matches and minimizes the number of gaps; and 2) Alkaline endoglucanase enzymes described in EP 1 350 843A published by Kao on Oct. 8, 2003 ([0011][0039] and examples 1-4).

Suitable lipases include those produced by *Pseudomonas* and Chromobacter, and LIPOLASE®, LIPOLASE ULTRA®, LIPOPRIME® and LIPEX® from Novozymes. See also Japanese Patent Application 53-20487, laid open on Feb. 24, 1978, available from Areario Pharmaceutical Co. Ltd., Nagoya, Japan, under the trade name Lipase P "Amano". Other commercial lipases include Amano-CES, lipases ex Chromobacter viscosum, available from Toyo Jozo Co., Tagata, Japan; and Chromobacter viscosum lipases from U.S. Biochemical Corp., U.S.A. and Diosynth Co., The Netherlands, and lipases ex *Pseudomonas gladioli*. Also suitable are cutinases [EC 3.1.1.50] and esterases.

Enzymes useful for liquid detergent formulations, and their incorporation into such formulations, are disclosed in U.S. Pat. No. 4,261,868 to Hora, et al., issued Apr. 14, 1981. In an embodiment, the liquid composition herein is substantially free of (i.e. contains no measurable amount of) wild-type protease enzymes. A typical combination is an enzyme cocktail that may comprise, for example, a protease and lipase in conjunction with amylase. When present in a cleaning composition, the aforementioned additional enzymes may be present at levels from about 0.00001% to about 2%, from about 0.0001% to about 1% or even from about 0.001% to about 0.5% enzyme protein by weight of the composition.

Enzyme Stabilizers—Enzymes for use in detergents can be stabilized by various techniques. The enzymes employed herein can be stabilized by the presence of water-soluble sources of calcium and/or magnesium ions in the finished compositions that provide such ions to the enzymes. In case of aqueous compositions comprising protease, a reversible protease inhibitor, such as a boron compound, can be added to further improve stability. A useful enzyme stabilizer system is a calcium and/or magnesium compound, boron compounds and substituted boric acids, aromatic borate esters, peptides and peptide derivatives, polyols, low molecular weight carboxylates, relatively hydrophobic organic compounds [e.g. certain esters, diakyl glycol ethers, alcohols or alcohol alkoxylates], alkyl ether carboxylate in addition to a calcium ion source, benzamidine hypochlorite, lower aliphatic alcohols and carboxylic acids, N,N-bis(carboxymethyl)serine salts; (meth)acrylic acid-(meth)acrylic acid ester copolymer and PEG; lignin compound, polyamide oligomer, glycolic acid or its salts; poly hexa methylene bi guanide or N,N-bis-3-amino-propyl-dodecyl amine or salt; and mixtures thereof. The detergent may contain a reversible protease inhibitor e.g., peptide or protein type, or a modified subtilisin inhibitor of family VI and the plasminostrepin; leupeptin, peptide trifluoromethyl ketone, or a peptide aldehyde. Enzyme stabilizers are present from about 1 to about 30, or from about 2 to about 20, or from about 5 to about 15, or from about 8 to about 12, millimoles of stabilizer ions per liter.

Catalytic Metal Complexes—Applicants' cleaning compositions may include catalytic metal complexes. One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

If desired, the compositions herein can be catalyzed by means of a manganese compound. Such compounds and levels of use are well known in the art and include, for example, the manganese-based catalysts disclosed in U.S. Pat. No. 5,576,282.

Cobalt bleach catalysts useful herein are known, and are described, for example, in U.S. Pat. No. 5,597,936; U.S. Pat. No. 5,595,967. Such cobalt catalysts are readily prepared by known procedures, such as taught for example in U.S. Pat. No. 5,597,936, and U.S. Pat. No. 5,595,967.

Compositions herein may also suitably include a transition metal complex of ligands such as bispidones (WO 05/042532 A1) and/or macropolycyclic rigid ligands—abbreviated as "MRLs". As a practical matter, and not by way of limitation, the compositions and processes herein can be adjusted to provide on the order of at least one part per hundred million of the active MRL species in the aqueous washing medium, and will typically provide from about 0.005 ppm to about 25 ppm, from about 0.05 ppm to about 10 ppm, or even from about 0.1 ppm to about 5 ppm, of the MRL in the wash liquor.

Suitable transition-metals in the instant transition-metal bleach catalyst include, for example, manganese, iron and chromium. Suitable MRLs include 5,12-diethyl-1,5,8,12-tetraazabicyclo[6.6.2]hexadecane.

Suitable transition metal MRLs are readily prepared by known procedures, such as taught for example in WO 00/32601, and U.S. Pat. No. 6,225,464.

Solvents—Suitable solvents include water and other solvents such as lipophilic fluids. Examples of suitable lipophilic fluids include siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, other environmentally-friendly solvents and mixtures thereof. In some embodiments, the solvent includes water. The water can include water from any source including deionized water, tap water, softened water, and combinations thereof. Solvents are typically present at from about 0.1% to about 50%, or from about 0.5% to about 35%, or from about 1% to about 15% by weight.

Form of the Compositions

The detergent compositions of the present invention may be of any suitable form, including paste, liquid, solid (such as tablets, powder/granules), foam or gel, with powders and tablets being preferred. The composition may be in the form of a unit dose product, i.e. a form which is designed to be used as a single portion of detergent composition in a washing operation. Of course, one or more of such single portions may be used in a cleaning operation.

Solid forms include, for example, in the form of a tablet, rod, ball or lozenge. The composition may be a particulate form, loose or pressed to shape or may be formed by injection moulding or by casting or by extrusion. The composition may be encased in a water soluble wrapping, for, example of PVOH or a cellulosic material. The solid product may be provided as a portioned product as desired.

The composition may also be in paste, gel or liquid form, including unit dose (portioned products) products. Examples include a paste, gel or liquid product at least partially surrounded by, and preferably substantially enclosed in a water-soluble coating, such as a polyvinyl alcohol package. This package may for instance take the form of a capsule, a pouch or a moulded casing (such as an injection moulded casing) etc. Preferably the composition is substantially surrounded by such a package, most preferably totally surrounded by such a package. Any such package may contain one or more product formats as referred to herein and the package may contain one or more compartments as desired, for example two, three or four compartments.

If the composition is a foam, a liquid or a gel it is preferably an aqueous composition although any suitable solvent may be used. According to an especially preferred embodiment of the present invention the composition is in the form of a tablet, most especially a tablet made from compressed particulate material.

If the compositions are in the form of a viscous liquid or gel they preferably have a viscosity of at least 50 mPas when measured with a Brookfield RV Viscometer at 25° C. with Spindle 1 at 30 rpm.

The compositions of the invention will typically be used by placing them in a detergent dispenser e.g. in a dishwasher machine draw or free standing dispensing device in an automatic dishwashing machine. However, if the composition is in the form of a foam, liquid or gel then it may be applied to by any additional suitable means into the dishwashing machine, for example by a trigger spray, squeeze bottle or an aerosol.

Processes of Making Cleaning Compositions

The compositions of the invention may be made by any suitable method depending upon their format. Suitable manufacturing methods for detergent compositions are well known in the art, non-limiting examples of which are described in U.S. Pat. Nos. 5,879,584; 5,691,297; 5,574,005; 5,569,645; 5,565,422; 5,516,448; 5,489,392; and 5,486,303. Various techniques for forming detergent compositions in solid forms are also well known in the art, for example, detergent tablets may be made by compacting granular/particular material and may be used herein.

In one aspect, the liquid detergent compositions disclosed herein may be prepared by combining the components thereof in any convenient order and by mixing, e.g., agitating, the resulting component combination to form a phase stable liquid detergent composition. In one aspect, a liquid matrix is formed containing at least a major proportion, or even substantially all, of the liquid components, with the liquid components being thoroughly admixed by imparting shear agitation to this liquid combination. For example, rapid stirring with a mechanical stirrer may usefully be employed. While shear agitation is maintained, substantially all of any anionic surfactant and the solid ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills are incorporated. As a variation of the composition preparation procedure described above, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques. All references cited herein are hereby incorporated in their entirety by reference.

Nonlimiting examples of reduced caustic detergent compositions according to the invention are listed below:

| component | exemplary 1 | exemplary 2 | exemplary 3 |
|---|---|---|---|
| water | 30-75 | 35-70 | 40-65 |
| anionic extended surfactant | 1-15 | 2-13 | 3-10 |
| nonionic extended surfactant | 2.5-25 | 5-20 | 10-15 |
| hydrotope | 10-35 | 15-30 | 20-25 |
| solvent | 2-10 | 3-8 | 4-6 |
| cationic source | .001-.5 | .01-3 | .05-2 |
| brightener | .5-3 | .75-2 | 1-1.5 |
| dispersant | 2-10 | 3-8 | 4-6 |

Example 1A

Extended Surfactants Compared with Formulas Containing NPEs and AEs

A tergitometer test was performed to determine the efficacy of an extended surfactant formula against commercial detergent formulas, listed below. The following conditions were used in the testing; DI water, 140° F., 10 minute wash, 1500 ppm active surfactant, 100 rpm, 2 half swatches of each of the following soils EMPA 101, EMPA 104, Soy/Soot Blend, Soy/Soot Cotton swatches. Each formula was tested with 0 ppm caustic and 1500 ppm caustic (from 50% NaOH) to determine the dependence on caustic for soil removal.

The results show that Commercial Detergent B relied heavily on caustic to increase soil removal, with a difference of 15.36% soil removal between 1500 ppm and 0 ppm caustic. The Commercial Detergent A and Commercial Detergent C formulas showed a significant caustic dependence, though less than the Commercial Detergent B formula, with 7.61 and 7.93% better soil removal for the 4 soil swatches respectively. The extended surfactant formula did not rely on caustic for increased performance, as the 1500 ppm caustic actually decreased performance showing reduced dependence on caustic for soil removal. Additionally, the extended surfactant formula did so with an increase in soil removal over the other formulas. The results are shown in FIG. 1.

| Formula | Caustic Level | Average % Soil Removal of 4 soil swatches | Difference between 1500 ppm and 0 ppm |
|---|---|---|---|
| Commercial Detergent A | 0 ppm | 53.76512 | |
| Commercial Detergent A | 1500 ppm | 61.69576 | 7.930647 |
| Commercial Detergent B | 0 ppm | 44.23423 | |
| Commercial Detergent B | 1500 ppm | 59.59321 | 15.35898 |
| Commercial Detergent C | 0 ppm | 52.45507 | |
| Commercial Detergent C | 1500 ppm | 60.06446 | 7.609385 |
| Experimental Formula | 0 ppm | 65.63667 | |
| Experimental Formula | 1500 ppm | 63.95789 | −1.67878 |

Commercial Detergent A is an NPE based detergent with 73.8% active surfactants, Commercial Detergent B is an AE based detergent with 72.14% active surfactants, and Commercial Detergent C is an AE based detergent with 75.07% active surfactants.

Example 1B

Reduced Caustic Dependence with Increasing Level of PO in the Anionic Extended Surfactant A tergitometer test was performed to determine the efficacy of various anionic extended surfactants. The performance of the formulas containing the various extended surfactants was compared to Commercial Detergent A. The formulas used are listed below. The following conditions were used in the testing; DI water, 140° F., 10 minute wash, 1500 ppm active surfactant, 70 rpm, 3 swatches of each of the following soils EMPA 101, EMPA 104, Soy/Soot Blend, Soy/Curry Cotton swatches. Each formula was tested with 0 ppm caustic and 1500 ppm caustic (from 50% NaOH) to determine the dependence on caustic for soil removal.

The following extended anionic surfactants were used in this testing:

| | Structure | PO extension |
|---|---|---|
| X-AES, 23% | $C_{12}(PO)_{16}(EO)_2SO_4^-$ | 16 |
| ALFOTERRA 123-4S, 30% | $C_{12-13}(PO)_4SO_4^-$ | 4 |
| ALFOTERRA 123-8S, 30% | $C_{12-13}(PO)_8SO_4^-$ | 8 |
| MARLOWET 4561, 90% | $C_{16-18}(PO)_4(EO)_5COO^-$ | 4 |
| MARLOWET 4560, 90% | $C_{16-18}(PO)_4(EO)_2COO^-$ | 4 |
| MARLOWET 4539, 90% | $C_9(PO)_2(EO)_2COO^-$ | 2 |

Figure 2:
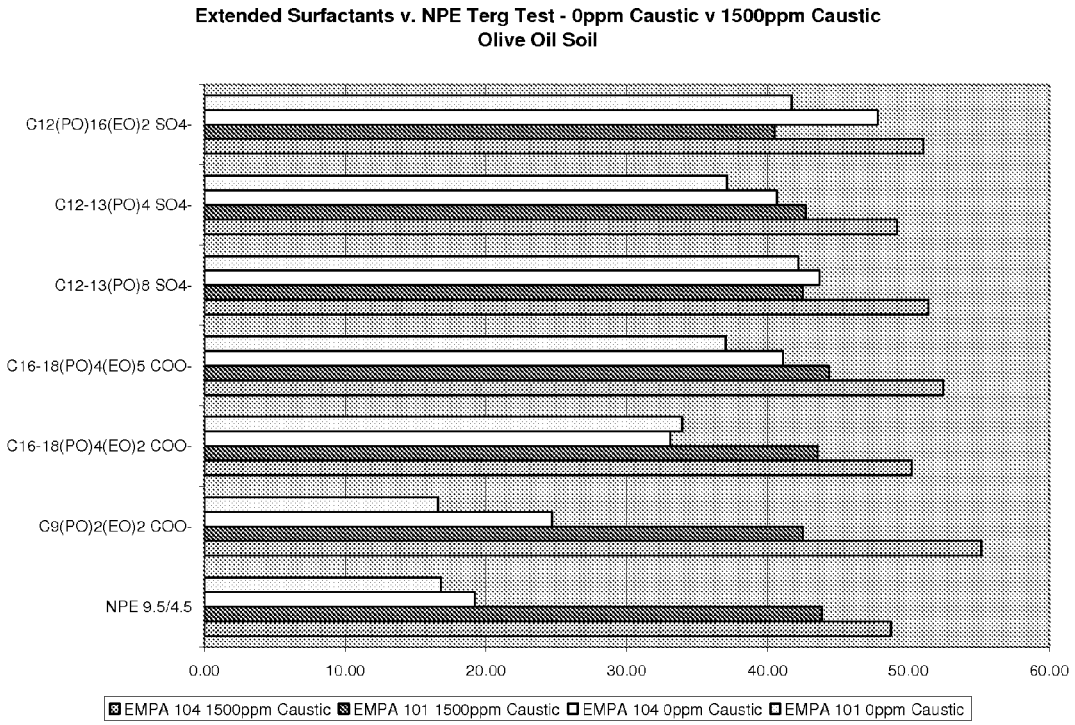
FIG. 2 is a graph of the extended surfactants vs NPE at 0 ppm caustic and 1500 ppm caustic.
Figure 3:
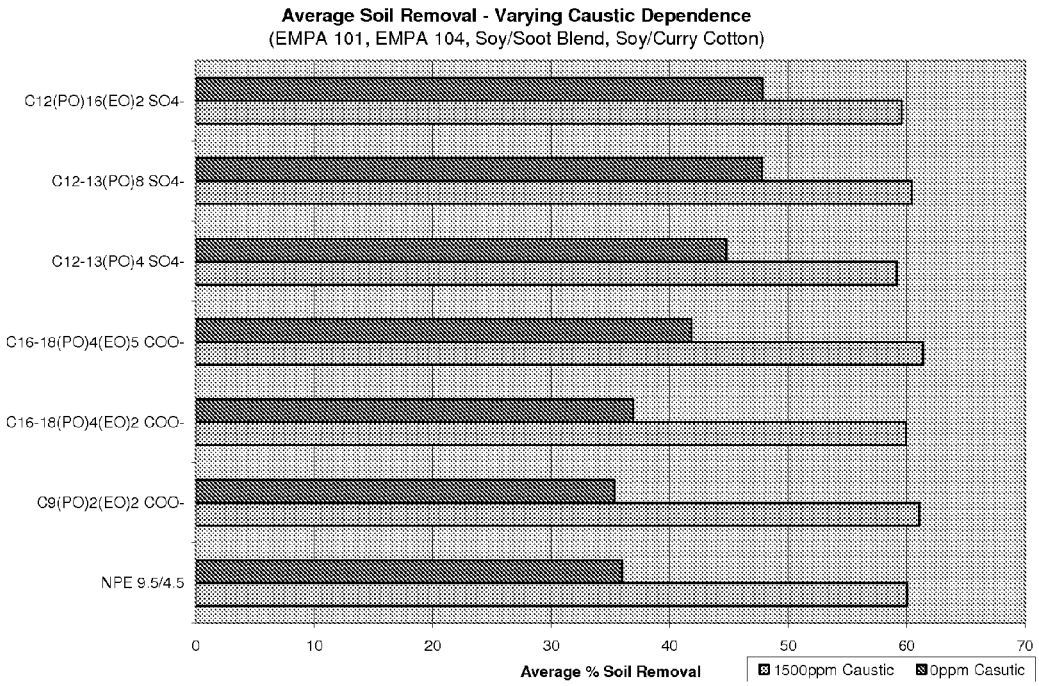
FIG. 3 is a graph of the average soil removal and varying caustic dependence for several extended chain anionic surfactants and NPE.

The results of this testing indicate that the higher the level of PO extension in the anionic extended surfactant, the less dependant on caustic the formula is across the four soil types. This is particularly apparent on the EMPA 104 swatch (olive oil on ploy/cotton blend). The results are shown in FIGS. 2 and 3.

Experimental Formulas used:

| Raw Material | RM Code | MCF WT % | A WT % | B WT % | C WT % | D WT % | E WT % |
|---|---|---|---|---|---|---|---|
| DI Water | | 2.25 | 13.3 | 13.3 | 37.52 | 37.52 | 37.52 |
| X-AES, 23% | Huntsman | 47.39 | | | | | |
| Ecosurf EH-6 | Dow | 10.89 | 10.89 | 10.89 | 10.89 | 10.89 | 10.89 |
| ALFOTERRA 123-4S, 30% | Sasol | | 36.33 | | | | |
| ALFOTERRA 123-8S, 30% | Sasol | | | 36.33 | | | |
| MARLOWET 4561, 90% | Sasol | | | | 12.11 | | |
| MARLOWET 4560, 90% | Sasol | | | | | 12.11 | |
| MARLOWET 4539, 90% | Sasol | | | | | | 12.11 |
| C12 AO, 30% | 172452 | 33.00 | 33.00 | 33.00 | 33.00 | 33.00 | 33.00 |
| Dissolvine GL-38 | | 2.78 | 2.78 | 2.78 | 2.78 | 2.78 | 2.78 |
| Trilon M, 40% | | 2.64 | 2.64 | 2.64 | 2.64 | 2.64 | 2.64 |
| MEA | | 1.06 | 1.06 | 1.06 | 1.06 | 1.06 | 1.06 |
| | Total | 100 | 100 | 100 | 100 | 100 | 100 |

Data:

| PO | Structure | Wash Conditions | Total Soil Removal (4 Soil types) | Average Soil Removal (4 Soil types) | Average 1500 ppm-Average 0 ppm |
|---|---|---|---|---|---|
| 0 | NPE 9.5/4.5 | Commercial Detergent A 1500 ppm Caustic | 240.09 | 60.02 | 24.02 |
| | | Commercial Detergent A w/o Caustic | 144.00 | 36.00 | |
| 2 | $C_9(PO)_2(EO)_2COO^-$ | MCF-E 1500 ppm Caustic | 244.19 | 61.05 | 25.73 |
| | | MCF-E w/o Caustic | 141.29 | 35.32 | |
| 4 | $C_{16-18}(PO)_4(EO)_2COO^-$ | MCF-D 1500 ppm Caustic | 239.77 | 59.94 | 23.06 |
| | | MCF-D w/o Caustic | 147.52 | 36.88 | |
| 4 | $C_{16-18}(PO)_4(EO)_5COO^-$ | MCF-C 1500 ppm Caustic | 245.41 | 61.35 | 19.53 |
| | | MCF-C w/o Caustic | 167.30 | 41.82 | |
| 8 | $C_{12-13}(PO)_8SO_4^-$ | MCF-B 1500 ppm Caustic | 241.89 | 60.47 | 12.67 |
| | | MCF-B w/o Caustic | 191.19 | 47.80 | |
| 4 | $C_{12-13}(PO)_4SO_4^-$ | MCF-A 1500 ppm Caustic | 236.71 | 59.18 | 14.41 |
| | | MCF-A w/o Caustic | 179.08 | 44.77 | |
| 16 | $C_{12}(PO)_{16}(EO)_2SO_4^-$ | MCF 1500 ppm Caustic | 238.35 | 59.59 | 11.75 |
| | | MCF w/o Caustic | 191.35 | 47.84 | |

Example 1C

Reduced Dependence on Caustic Across a Broad Range of Caustic Levels with 16PO Extended Anionic A tergitometer test was performed with an extended surfactant formula and varying caustic levels to determine if there is a point at which the formula shows a dependence on caustic. The following conditions were used in the testing; DI water, 150° F., 10 minute wash, 100 rpm, and 9.39 g/L extended formula (listed below) added to the wash pot. A Builder, with a high recommended alkalinity use level at and 0, 1, 3, 5, 7, 9 and 11 grams of Builder per 1 L wash solution added into wash pot. Terry swatches were soiled with 0.30 g of Soybean oil and allowed to set overnight. Three soiled swatches were used in each wash solution.

Figure 4:
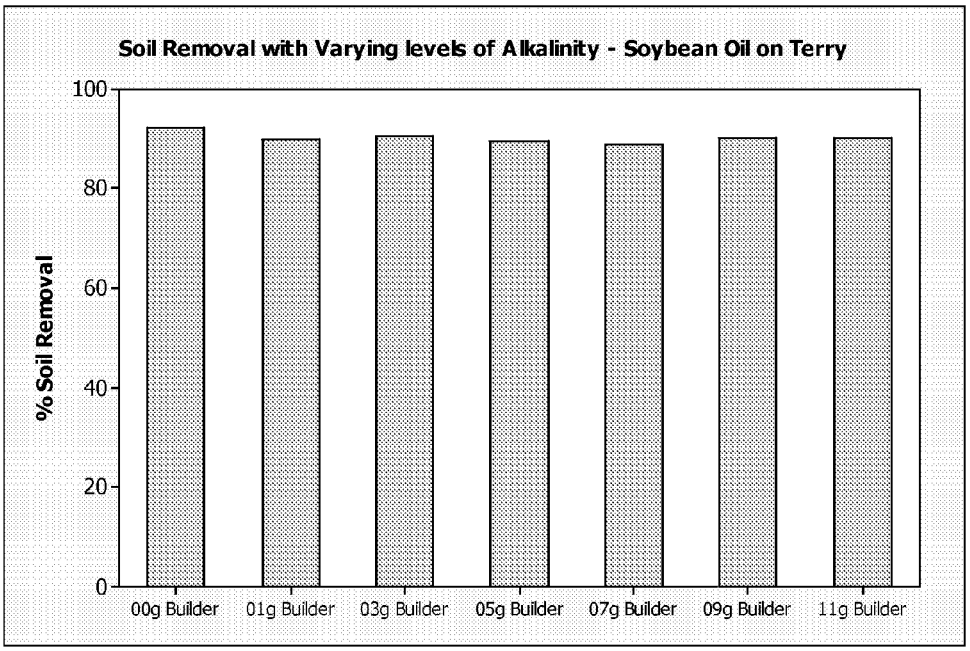
FIG. 4 is a graph of the percent soil removal of soybean oil with various builder levels.
Figure 5:
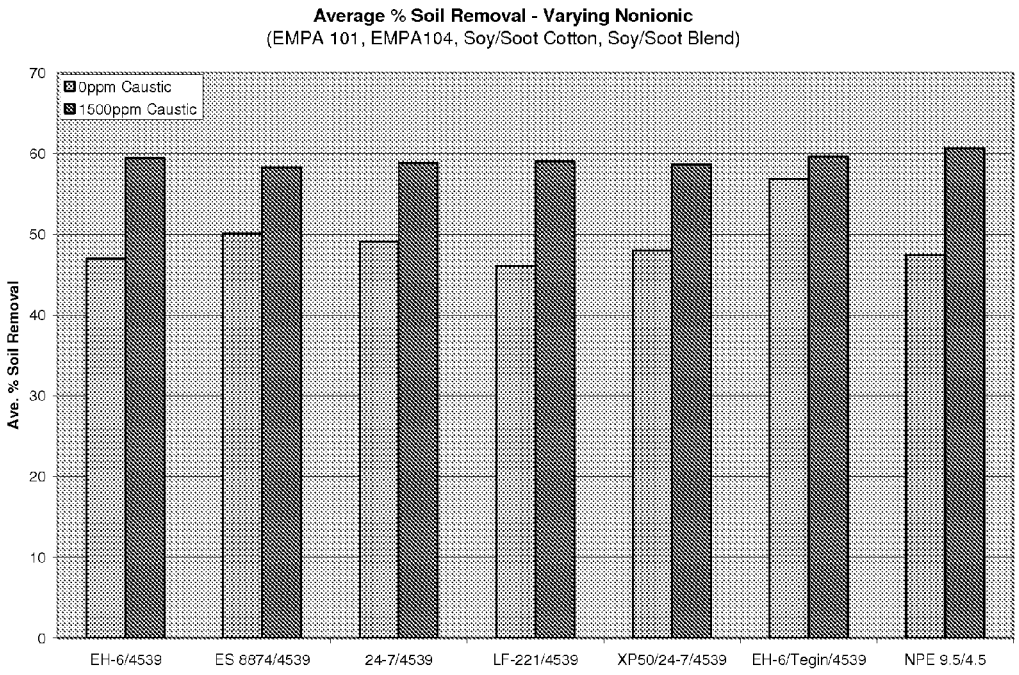
FIG. 5 is a graph of the average soils removal with varying nonionic extended chain surfactants and NPE.

The extended anionic surfactant used in this formula is the X-AES with 16 PO. The results of this testing show there is no point at which caustic alkalinity improves soil removal. This is consistent with the previous examples, wherein the extended anionics with higher levels of PO had less caustic dependence. The results are shown in FIG. 4.

Formulas:

| Raw Material | WT % |
|---|---|
| DI Water | 47.27876 |
| X-AES, 23% | 15.88496 |
| Plurafac SL-42 | 3.650442 |
| C12 AO, 30% | 11.06195 |
| Dissolvine GL-38 | 22.12389 |
| Total | 100.00 |

The Builder formula is a builder system with 31.5% active sodium hydroxide.

Example 1D

Reduced Caustic Dependence with Optimized Nonionic Extended Surfactant

A tergitometer test was performed to determine if non-extended nonionics perform as well as the extended nonionic system. The anionic used was the Marlowet 4539 (2 PO). The non-extended nonionics were compared with Ecosurf EH-6 and an optimized Ecosurf EH-6 with a linker (Tegin ISO).

The following conditions were used in the testing; DI water, 140° F., 10 minute wash, 1500 ppm active surfactant, 70 rpm, 2 half swatches of each of the following soils EMPA 101, EMPA 104, Soy/Soot Blend, Soy/Soot Cotton swatches (from Test Fabrics). Each formula was tested with 0 ppm caustic and 1500 ppm caustic (from 50% NaOH) to determine the dependence on caustic for soil removal.

Figure 6:
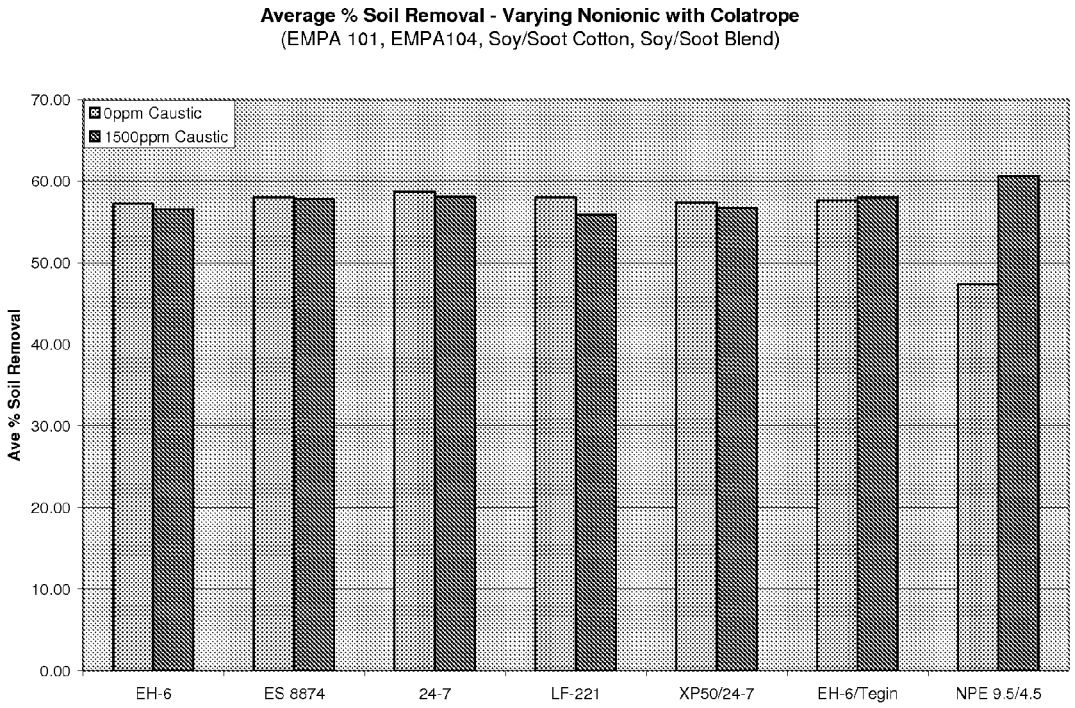
FIG. 6 is a graph of the average percent oil removal for varying nonionic surfactants with colatrope.

The results of this test show that the non-extended nonionic formulas as well as the non-optimized EH-6 formula exhibit a dependence on caustic for improved soil removal. However, the optimized nonionic EH-6/Tegin formula showed a significant decrease in caustic dependence. The 2PO anionic surfactant (MARLOWET 4539) does not have a large enough hydrophopic portion to significantly reduce caustic dependance. The TEGIN ISO bridges the gap in the lack of hydrophobicity in the formula, allowing the dependence on caustic to be further reduced. The results are shown in FIG. 6.

| Non-Extended Surfactants | Source | Type |
|---|---|---|
| Surfonic L24-7 | Huntsman | Alcohol Ethoxylate |
| ES 8874 | BASF | Proprietary |
| Lutensol XP-50 | BASF | Guerbet Alcohol Ethoxylate |
| Plurafac LF 221 | BASF | Alcohol Alkoxylate |

Formulas used:

| Raw Material | EH-6/ 4539 WT % | ES 8874/ 4539 | 24-7/ 4539 | LF-221/ 4539 | XP-50/ 24-7/ 4539 | EH-6/ Tegin/ 4539 |
|---|---|---|---|---|---|---|
| DI Water | 37.52 | 37.52 | 37.52 | 37.52 | 37.52 | 42.98 |
| Ecosurf EH-6 | 10.89 | | | | | 10.89 |
| MARLOWET 4539, 90% | 12.11 | 12.11 | 12.11 | 12.11 | 12.11 | 9.39 |
| C12 AO, 30% | 33.00 | 33.00 | 33.00 | 33.00 | 33.00 | 25.59 |
| ES 8874 | | 10.89 | | | | |
| L24-7 | | | 10.89 | | 2.7225 | |
| XP 50 | | | | | 8.1675 | |
| LF-221 | | | | 10.89 | | |
| Tegin ISO | | | | | | 4.67 |
| Dissolvine GL-38 | 2.78 | 2.78 | 2.78 | 2.78 | 2.78 | 2.78 |
| Trilon M, 40% | 2.64 | 2.64 | 2.64 | 2.64 | 2.64 | 2.64 |
| MEA | 1.06 | 1.06 | 1.06 | 1.06 | 1.06 | 1.06 |
| | 100.00 | 100.00 | 100.00 | 100.00 | 100.00 | 100.00 |

The NPE 9.5/4.5 is Commercial Detergent A formula.

Example 1E

Testing with Colatrope with Extended and Non-Extended Nonionic Surfactants

A tergitometer test was performed to determine if colatrope works as well as the nonionics used in the previous test. The following conditions were used in the testing; DI water, 140° F., 10 minute wash, 1500 ppm active surfactant, 70 rpm, 2 half swatches of each of the following soils EMPA 101, EMPA 104, Soy/Soot Blend, Soy/Soot Cotton swatches (from Test Fabrics). Each formula was tested with 0 ppm caustic and 1500 ppm caustic (from 50% NaOH) to determine the dependence on caustic for soil removal.

Figure 7:
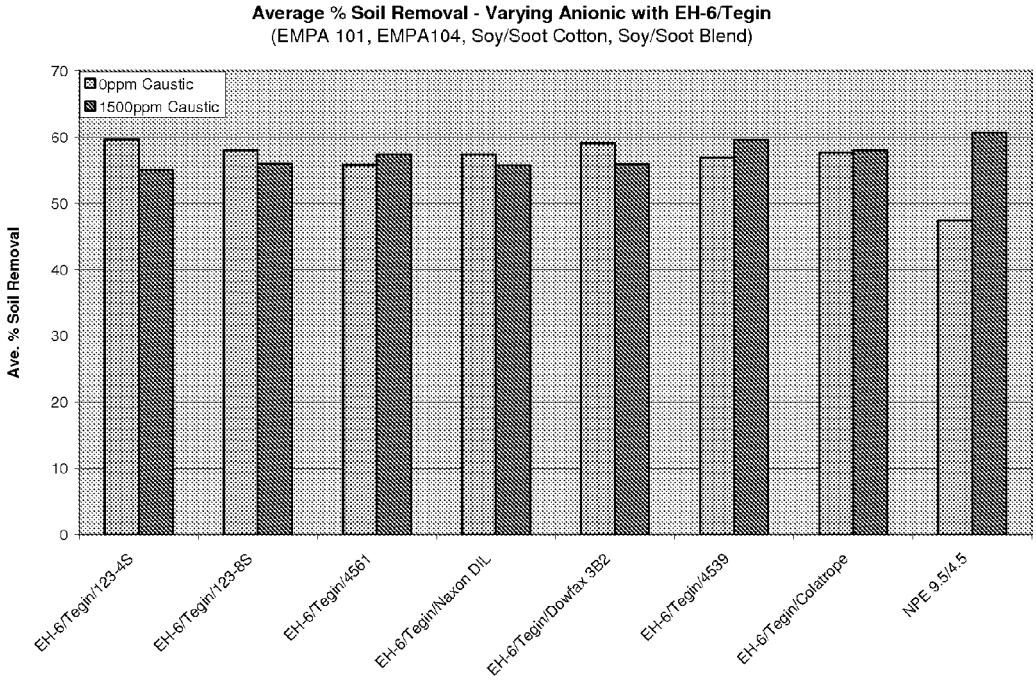
FIG. 7 is a graph of the average percent soil removal of varying anionic surfactants with nonionic surfactants and tegin.

The results of this test show that the anionic portion has an impact on the reduced caustic dependence. Also of note, since the colatrope is neutral, it likely does not bring down the pH as opposed to the MARLOWET 4539. The results are shown in FIG. 7.

Formulas used:

| Raw Material | EH-6 | ES 8874 | 24-7 | LF-221 | XP50/ 24-7 | EH-6/ TEgin |
|---|---|---|---|---|---|---|
| DI Water | 25.41 | 25.41 | 25.41 | 25.41 | 25.41 | 33.59 |
| Ecosurf EH-6 | 10.89 | | | | | 10.89 |
| C12 AO, 30% | 33.00 | 33.00 | 33.00 | 33.00 | 33.00 | 25.59 |
| ES 8874 | | 10.89 | | | | |
| L24-7 | | | 10.89 | | 2.7225 | |
| XP 50 | | | | | 8.1675 | |
| LF-221 | | | | 10.89 | | |
| Tegin | | | | | | 4.67 |
| Colatrope, 45% | 24.22 | 24.22 | 24.22 | 24.22 | 24.22 | 18.78 |
| Dissolvine GL-38 | 2.78 | 2.78 | 2.78 | 2.78 | 2.78 | 2.78 |
| Trilon M, 40% | 2.64 | 2.64 | 2.64 | 2.64 | 2.64 | 2.64 |
| MEA | 1.06 | 1.06 | 1.06 | 1.06 | 1.06 | 1.06 |
| | 100.00 | 100.00 | 100.00 | 100.00 | 100.00 | 100.00 |

The NPE 9.5/4.5 is Commercial Detergent A.

Example 1F

Optimized Nonionic Surfactant System with Various Anionic Surfactants

A tergitometer test was performed to evaluate several anionic surfactants (both extended and non-extended) with the optimized EH-6/Tegin nonionic system. The following conditions were used in the testing; DI water, 140° F., 10 minute wash, 1500 ppm active surfactant, 100 rpm, 2 half swatches of each of the following soils EMPA 101, EMPA 104, Soy/Soot Blend, Soy/Soot Cotton swatches. Each formula was tested with 0 ppm caustic and 1500 ppm caustic (from 50% NaOH) to determine the dependence on caustic for soil removal.

Figure 8:
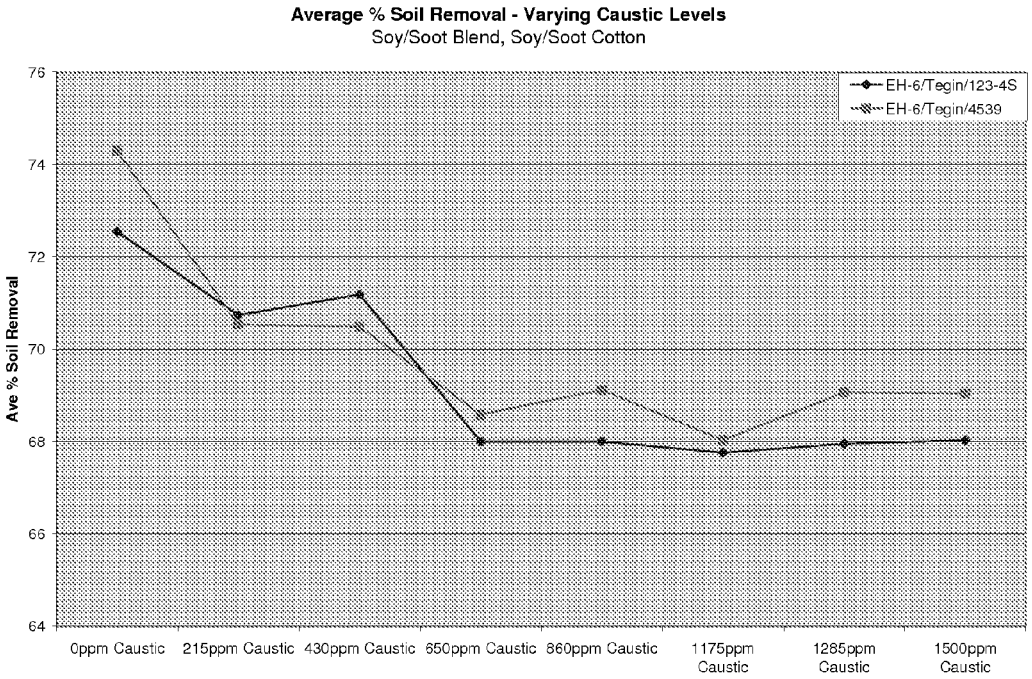
FIG. 8 is a graph of the average soil removal with varying caustic levels of the nonionic surfactants and tegin.
Figure 9:
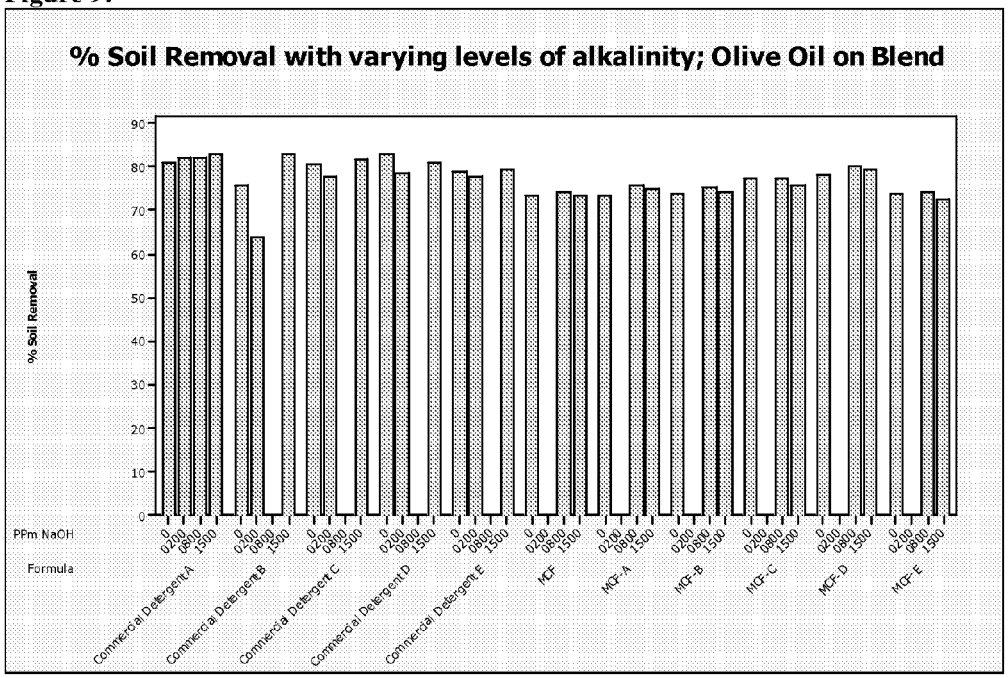
FIGS. 9-13 are graphs of percent soil removal with different oils and different fabric types with various combinations of extended surfactants, AE and NPE.
Figure 10:
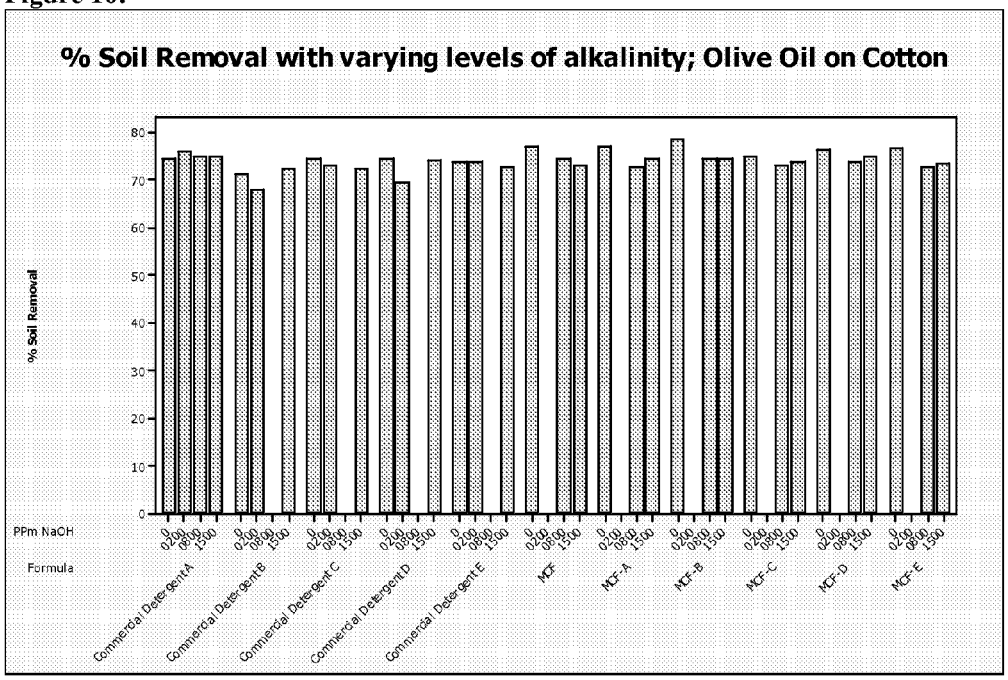
Figure 11:
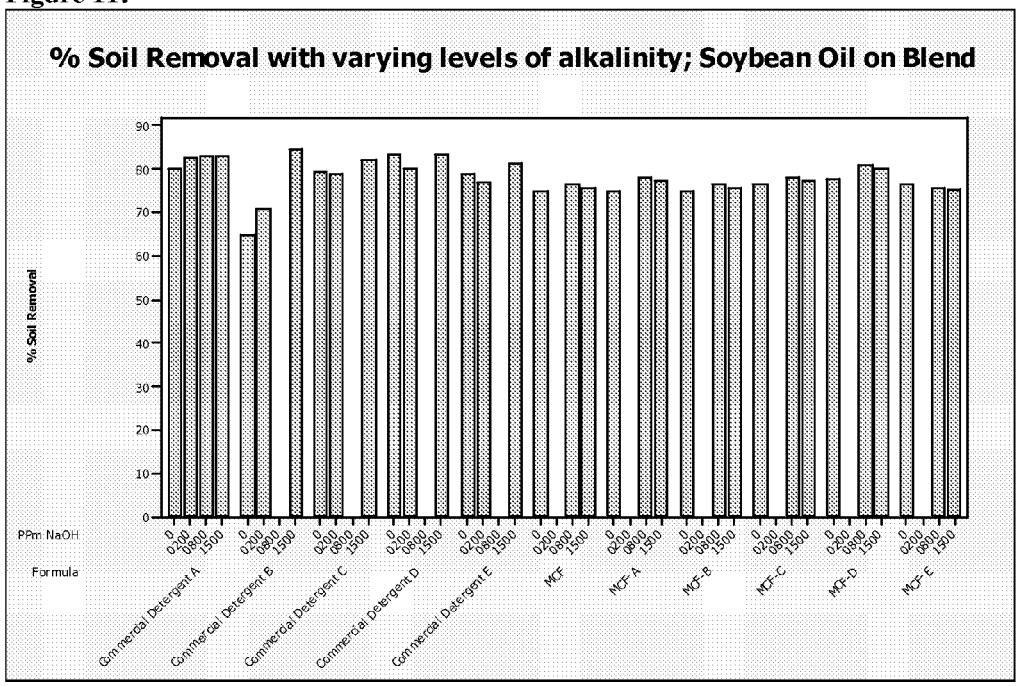
Figure 12:
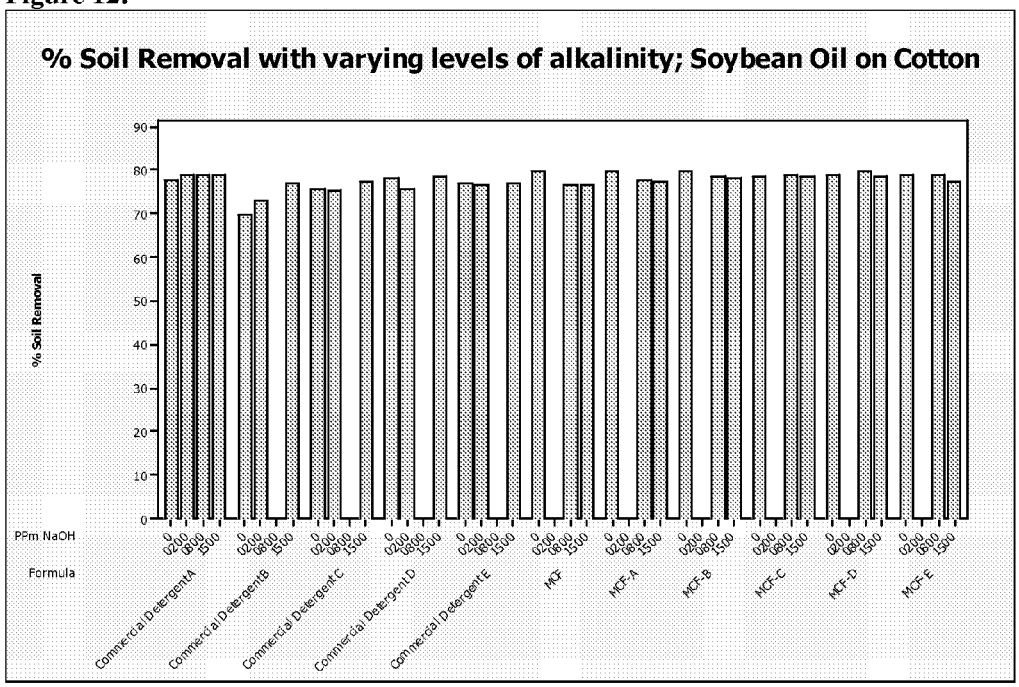
Figure 13:
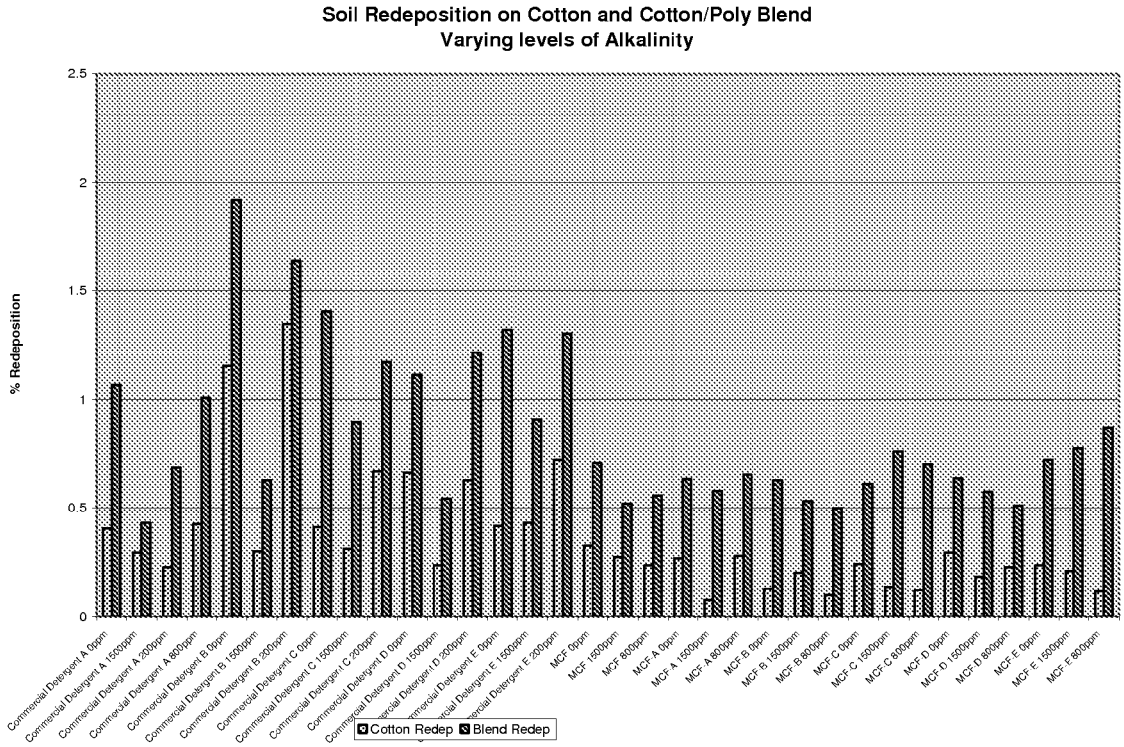

This test confirms the prior results showing a reduced dependence on caustic with the optimized extended nonionics. Additionally, comparing the Alfoterra 123-8S (8PO), Alfoterra 123-4S (4PO), Marlowet 4561 (4PO), and Marlowet 4539 (2PO), we again see the decreased dependence on caustic with increased PO. The results are shown in FIG. 8.

| Non-Extended Surfactants | Source | Type |
|---|---|---|
| Naxan DIL | Nease | Sodium diisopropylnapthalenesulfonate |
| Dowfax 3B2 | Dow | Mono & didecyl disulfonated diphenyl |

Formulas used:

| Raw Material | EH-6/ Tegin/ 4539 | EH-6/ Tegin/ Colatrope | EH-6/ Tegin/ 123-4S | EH-6/ Tegin/ 123-8S | EH-6/ Tegin/ 4561 | Eh-6/ Tegin/ Naxan DIL | EH-6/ Tegin/ Dowfax 3B2 |
|---|---|---|---|---|---|---|---|
| DI Water | 42.98 | 33.59 | 24.2 | 24.2 | 42.98 | 28.23 | 34.39 |
| Ecosurf EH-6 | 10.89 | 10.89 | 10.89 | 10.89 | 10.89 | 10.89 | 10.89 |
| ALFOTERRA 123-4S, 30% | | | 28.17 | | | | |
| ALFOTERRA 123-8S, 30% | | | | 28.17 | | | |
| MARLOWET 4561, 90% | | | | | 9.39 | | |
| MARLOWET 4539, 90% | 9.39 | | | | | | |
| C12 AO, 30% | 25.59 | 25.59 | 25.59 | 25.59 | 25.59 | 25.59 | 25.59 |
| Naxan DIL, 35% | | | | | | 24.14 | |
| Dowfax 3B2 | | | | | | | 17.98 |
| Tegin | 4.67 | 4.67 | 4.67 | 4.67 | 4.67 | 4.67 | 4.67 |
| Colatrope, 45% | | 18.78 | | | | | |
| Dissolvine GL-38 | 2.78 | 2.78 | 2.78 | 2.78 | 2.78 | 2.78 | 2.78 |
| Trilon M, 40% | 2.64 | 2.64 | 2.64 | 2.64 | 2.64 | 2.64 | 2.64 |
| MEA | 1.06 | 1.06 | 1.06 | 1.06 | 1.06 | 1.06 | 1.06 |
| | 100.00 | 100.00 | 100.00 | 100.00 | 100.00 | 100.00 | 100.00 |

The NPE 9.5/4.5 is Commercial Detergent A

Example 1G

Varying Caustic Levels with 2PO and 4PO Extended Anionic Surfactants

A tergitometer test was run with formulas containing 4PO and 2PO extended anionic surfactants with the optimized extended nonionic system. The following conditions were used in the testing; DI water, 140° F., 10 minute wash, 1500 ppm active surfactant, 100 rpm, 2 half swatches of each of the following soils EMPA 101, EMPA 104, Soy/Soot Blend, Soy/Soot Cotton swatches. The caustic level with these formulas was tested at 0, 215, 430, 650, 860, 1175, 1285, and 1500 ppm caustic (from 50% NaOH).

The results of this testing again show that the 4PO (Alfoterra 123-4S) has less caustic dependence than the 2PO (Marlowet 4539). However, this testing also shows a point at which the additional caustic does not further decrease overall soil removal. This is important as some caustic may be desirable in the wash solution, for example, if necessary to break the polymerization of oily soils.

Formulas used

| Raw Material | RM Code | EH-6/Tegin/ 123-4S (4PO) | EH-6/Tegin/ 4539 (2PO) |
|---|---|---|---|
| DI Water | | 42.98 | 24.2 |
| Ecosurf EH-6 | Dow | 10.89 | 10.89 |
| ALFOTERRA 123-4S, 30% | Sasol | | 28.17 |
| MARLOWET 4539, 90% | Sasol | 9.39 | |
| C12 AO, 30% | 172452 | 25.59 | 25.59 |
| Tegin | | 4.67 | 4.67 |

-continued

| Raw Material | RM Code | EH-6/Tegin/ 123-4S (4PO) | EH-6/Tegin/ 4539 (2PO) |
|---|---|---|---|
| Dissolvine GL-38 | | 2.78 | 2.78 |
| Trilon M, 40% | | 2.64 | 2.64 |
| MEA | | 1.06 | 1.06 |
| | | 100.00 | 100.00 |

The results are shown in FIGS. 9-13.

Example 1H

Extended Surfactants Compared with Current in-Line Formulas Containing NPEs and AEs with Sudan IV Dyed Oil A tergitometer test was performed to determine the efficacy of extended surfactant formulas against Commercial Detergent formulas, listed below. The following conditions were used in the testing; DI water, 140° F., 10 minute wash, 1500 ppm active surfactant, 100 rpm, 2 half swatches of each of the following soils, and 1 half unsoiled blend swatch and 1 half unsoiled cotton swatch. Each formula was tested with 0 ppm caustic, either 200 ppm caustic or 800 ppm caustic, and 1500 ppm caustic (from 50% NaOH).

The swatches were prepared as follows:

a. 300 g Soybean oil dyed with 0.05 g Sudan IV dye.

b. 300 g Olive oil dyed with 0.05 g Sudan IV dye.

c. STC EMPA 211 (cotton percale, bleached without optical brightener)

d. STC EMPA 213 (polyester/cotton 65/35, bleached without optical brightener e. The swatches were saturated with the oil, placed between blotter sheets, and run through the padder with 45 pounds of weight.

f. The swatches were placed on racks and allowed to cure for testing.

The results show that there is no caustic dependence for the formulas containing extended surfactants. Additionally, there is, in general, significantly less soil redeposition with the extended surfactant formulas. The results are shown in FIGS. 9-13.

Formulas:

Commercial Detergent A is an NPE based detergent with 73.80% active surfactants, Commercial Detergent B is an AE based detergent with 72.14% active surfactants, Commercial Detergent C is an AE based detergent with 75.07% active surfactants, Commercial Detergent D is an NPE based detergent with 80.00% active surfactants, and Commercial Detergent E is an AE based detergent with 52.8% active surfactants.

| Raw Material | MCF WT % | A WT % | B WT % | C WT % | D WT % | E WT % |
|---|---|---|---|---|---|---|
| DI Water | 2.25 | 13.3 | 13.3 | 37.52 | 37.52 | 37.52 |
| X-AES, 23% | 47.39 | | | | | |
| Ecosurf EH-6 | 10.89 | 10.89 | 10.89 | 10.89 | 10.89 | 10.89 |
| ALFOTERRA 123-4S, 30% | | 36.33 | | | | |
| ALFOTERRA 123-8S, 30% | | | 36.33 | | | |
| MARLOWET 4561, 90% | | | | 12.11 | | |
| MARLOWET 4560, 90% | | | | | 12.11 | |
| MARLOWET 4539, 90% | | | | | | 12.11 |
| C12 AO, 30% | 33.00 | 33.00 | 33.00 | 33.00 | 33.00 | 33.00 |
| Dissolvine GL-38 | 2.78 | 2.78 | 2.78 | 2.78 | 2.78 | 2.78 |
| Trilon M, 40% | 2.64 | 2.64 | 2.64 | 2.64 | 2.64 | 2.64 |
| MEA | 1.06 | 1.06 | 1.06 | 1.06 | 1.06 | 1.06 |
| Total | 100 | 100 | 100 | 100 | 100 | 100 |

Example 2

Tables A-F, illustrated below, illustrate certain microemulsion forming formulas that can be used. Table A illustrates formulas including 15%, 20% and 25% EDTA. Table B illustrates formulas including 10%, 15% and 20% MGDA. Table C illustrates formulas including 10% and 20% GLDA. Table D illustrates formulas containing monoethanolamine which acts as a weak base to add alkalinity to the formula for enhanced performance and cleaning and also a linker to boost the efficacy of the surfactants. Tables E and F illustrate maximum concentration microemulsion forming formulas incorporating an anionic surfactant to work in synergy with the non-ionic surfactant.

TABLE A

| | 15% EDTA | 20% EDTA | 25% EDTA |
|---|---|---|---|
| DI Water | 57.34 | 52.34 | 47.34 |
| X-AES, 23% | 14.36 | 14.36 | 14.36 |
| Plurafac SL-42 | 3.30 | 3.30 | 3.30 |
| Barlox 12, 30% | 10.00 | 10.00 | 10.00 |
| EDTA, 40% | 15.00 | 20.00 | 25.00 |
| TOTAL | 100.00 | 100.00 | 100.00 |
| Cloud Point, ° F. | 132 | 114 | 99 |
| % Active Chelant | 6 | 8 | 10 |
| % Active Surfactant | 9.6 | 9.6 | 9.6 |

TABLE B

| | 10% MGDA | 15% MGDA | 20% MGDA |
|---|---|---|---|
| DI Water | 62.34 | 57.34 | 52.34 |
| X-AES, 23% | 14.36 | 14.36 | 14.36 |
| Plurafac SL-42 | 3.30 | 3.30 | 3.30 |
| Barlox 12, 30% | 10.00 | 10.00 | 10.00 |
| MGDA, 40% | 10.00 | 15.00 | 20.00 |
| TOTAL | 100.00 | 100.00 | 100.00 |
| Cloud Point, ° F. | 146 | 124 | 115 |
| % Active Chelant | 4 | 6 | 8 |

TABLE B-continued

| | 10% MGDA | 15% MGDA | 20% MGDA |
|---|---|---|---|
| % Active Surfactant | 9.6 | 9.6 | 9.6 |

TABLE C

| | 10% GLDA | 20% GLDA |
|---|---|---|
| DI Water | 62.34 | 52.34 |
| X-AES, 23% | 14.36 | 14.36 |
| Plurafac SL-42 | 3.30 | 3.30 |
| Barlox 12, 30% | 10.00 | 10.00 |
| GLDA, 38% | 10.00 | 20.00 |
| TOTAL | 100.00 | 100.00 |
| Cloud Point, ° F. | 131 | ~90 |
| % Active Chelant | 3.8 | 7.6 |
| % Active Surfactant | 9.6 | 9.6 |

TABLE D

| | μEM #9 Forming formula | μEM #10 Forming formula | μEM #11 Forming formula | μEM #12 Forming formula | μEM #13 Forming formula |
|---|---|---|---|---|---|
| DI Water | 52.34 | 47.34 | 42.34 | 66.70 | 76.70 |
| X-AES, 23% | 14.36 | 14.36 | 14.36 | | |
| EH-6 | 3.30 | 3.30 | 3.30 | 23.30 | 23.30 |
| Barlox 12, 30% | 10.00 | 10.00 | 10.00 | | |
| GLDA, 38% | 10.00 | 10.00 | 10.00 | | |
| MGDA, 40% | 10.00 | 10.00 | 10.00 | | |
| MEA | | 5.00 | 10.00 | | |
| Tegin ISO | | | | 10.00 | |
| TOTAL | 100.00 | 100.00 | 100.00 | 100.00 | 100.00 |
| Cloud Point, ° F. | 112 | 116 | 120 | | |
| % Active Chelant | 7.8 | 7.8 | 7.8 | | |
| % Active Surfactant | 9.6 | 9.6 | 9.6 | 23.3 | 23.3 |

TABLE E

| | MCF (Maximum Concentration Formula) | MCF-A | MCF-B | MCF-C | MCF-D | MCF-E |
|---|---|---|---|---|---|---|
| DI Water | 2.25 | 13.3 | 13.3 | 37.52 | 37.52 | 37.52 |
| EH-6 | 10.89 | 10.89 | 10.89 | 10.89 | 10.89 | 10.89 |
| X-AES, 23% | 47.39 | | | | | |
| Alfoterra 123-4S, 30% | | 36.33 | | | | |
| Alfoterra 123-8S, 30% | | | 36.33 | | | |
| Marlowet 4561, 90% | | | | 12.11 | | |
| Marlowet 4560, 90% | | | | | 12.11 | |
| Marlowet 4539, 90% | | | | | | 12.11 |
| Barlox 12, 30% | 33.00 | 33.00 | 33.00 | 33.00 | 33.00 | 33.00 |
| Dissolvine GL-38S | 2.78 | 2.78 | 2.78 | 2.78 | 2.78 | 2.78 |
| Trilon M, 40% | 2.64 | 2.64 | 2.64 | 2.64 | 2.64 | 2.64 |
| MEA | 1.06 | 1.06 | 1.06 | 1.06 | 1.06 | 1.06 |
| TOTAL | 100.01 | 100.00 | 100.00 | 100.00 | 100.00 | 100.00 |
| Foam Ht, ml (1500 ppm active surfactant) | 60 | 75 | 59 | 53 | 40 | 54 |
| % Active Chelant | 2.11 | 2.11 | 2.11 | 2.11 | 2.11 | 2.11 |
| % Active Surfactant | 31.69 | 31.69 | 31.69 | 31.69 | 31.69 | 31.69 |
| 100% pH | 10.98 | 11.24 | 11.17 | 10.16 | 9.84 | 8.88 |

According to the invention, applicants have identified several general principals. First that greasy soils are mostly removed by surfactants, especially non-ionic surfactants, second, that alkalinity is mostly only effective on particulate soils including carbon black. Without wishing to be bound by any theory, applicants submit that it works by imparting negative charges (in other words, changing the zeta potential) on these particles, and helps their removal by electrostatic repulsion.

Applicants further surmise that alkalinity is not effective and necessary on greasy soil unless the greasy soil is somewhat polymerized (triglycerides, especially non-transfats, are capable of polymerization). Alkalinity is very effective in breaking down the polymerized triglyceride network. Real world soils are quite often complex soils comprising both greasy and particulate soils. The use of extended surfactants shifts the required optimal alkalinity to significantly lower level. In other words, the use of extended surfactants reduces the dependence on alkalinity or caustics for detergency. This has important benefits including, but not limited to, cost saving, use of less aggressive composition for better worker safety, less fabric damage (laundry), and less corrosion issues due to the alkalinity (caustics).

The invention has many applications and uses which include but are not limited to: laundry cleaning, and reduction of laundry fire due to non-transfats, hard surface cleaning such as manual pot-n-pan cleaning, machine warewashing, all purpose cleaning, floor cleaning, CIP cleaning, open facility cleaning, foam cleaning, vehicle cleaning, etc.

Example 3

Extended Chain Surfactant Detergent Compositions And Sunscreen Removal

There are increasing reports around of yellow stains on linen that are believed to be caused by sunscreen formulations. These stains are not visible prior to the wash, but typically appear on the linen (usually cotton towels) as yellow patches after washing with detergent-builder combinations at high pH, especially when using chlorine bleach. In other words, the stains are "set" by alkali and chlorine bleach. If the water quality is poor and high levels of iron are present the yellow spots can even become orange in color.

Attempts in the field to remove these stains using normal combinations of detergents, detergency boosters, and bleach have not been successful. It has been reported that using mild neutral detergent with oxygen bleach does not tend to form the stains, but this combination also does not offer the level of cleaning performance desired.

These sunscreen formulations contain a variety of active ingredients, but the ones of most concern are the polyphenyl aromatics Oxybenzone and Avobenzone. Sunscreen formulations with higher Sun Protective Factors (SPFs) contain more of these actives, and form more severe yellow stains. Formulations that lack these actives to do not tend to form yellow stains. Both of these structures have active (acidic) hydrogen which helps to explain the effect of the alkali, which is believed to react with the actives to form salts that are highly colored. It can also explain the effect of the final sour, in that the acid protonates the colored salts to regenerate the less colored acid forms.

One possible example of this detergency booster composition is shown in Table 1. This is a blend of extended surfactants (Ecosurf SA9 and SA4 by Dow Chemical, Marlowet 4560 by Sasol), solvents (butyl carbitol and Dowanol PPH by Dow Chemical), and amine oxide (Barlox 12 by Lonza), that was superior to other blends of surfactants tested.

TABLE 1

STL-7 Composition

| STL-7 | Amount (%) |
|---|---|
| Ecosurf SA9 | 28 |
| Ecosurf SA4 | 22 |
| Marlowet 4539 LF | 10 |
| Butyl Carbitol | 14.75 |
| PPH | 14.75 |
| Barlox 12 | 5 |
| LAS | 5 |
| Momentive Y-14865 silicone antifoam | 0.5 |

To test this STL-7 composition we prepared test samples by coating eight 2" by 3" cotton terry swatches with 0.5 g each of "Coppertone 70 SPF Ultraguard" sunscreen lotion, and allowed the swatches to sit overnight. We then washed the swatches with 25 lbs of cotton fills in a 35 lb front loading I&I industrial washing machine under various conditions. After washing the swatches were allowed to dry, and then measured with a Hunter Colorimeter to determine the "b*" value of the swatches. This b* value is a measure of the yellowness of the sample, with higher positive b* values denoting a sample that is more highly yellow—or more highly stained. By reporting a Δb* or the difference in b* value between the final washed and treated swatch with the b* value of the starting uncoated terry swatch we can quantitate the severity of the resulting yellow stain, and compare various treatment options. In this case a larger positive value of Δb* denotes a stain that is more yellow than a smaller positive value.

Table 2 below shows a comparison using fresh stains in which detergency booster is added to the flush step of the laundry process, which is essentially a short pre-wash step prior to the normal suds step. First is shown a control with no flush step, followed by a run in which additional standard detergent is added during the flush step to demonstrate that the improvements are not all due to just an extended wash time. Run #3 shows the performance of a commercially available detergency booster from CHT called Beiclean FDO#2, while Run #4 shows the performance of a commercially available detergency booster from Ecolab called Dermasil. Finally Run #5 shows the performance of the STL-7 detergency booster of this invention. Since the Δb* of the STL-7 run had the lowest value, this composition produced swatches with the least amount of yellow color, and therefore did the best in this series at removing fresh sunscreen stains.

TABLE 2

Boosters on Fresh Stains in Flush Step

| Run # | Sample | Δb* |
|---|---|---|
| 1 | Control—no Flush | 10.8 |
| 2 | Detergent in Flush step | 8.7 |
| 3 | Beiclean FDO #2 in Flush | 7.7 |
| 4 | Dermasil in Flush | 9.6 |
| 5 | STL-7 in Flush | 6.9 |

The next question was whether this type of detergency booster would work better in the flush step, or when added to the suds step in addition to the regular detergent (Table 3). Run #1 is the previous control with no added detergent booster, while Runs #2 and #3 respectively are for added Beiclean and Dermasil in the suds step, and Run #4 is for added STL-7 to the suds step. Here the STL-7 again performs the best, but in all cases the effect is reduced, showing that the effect of the detergency booster is greater in the flush step than in the suds step.

TABLE 3

Boosters on Fresh Stains in Suds Step

| Run # | Sample | Δb* |
|---|---|---|
| 1 | Control—no Flush | 10.8 |
| 2 | Beiclean FDO #2 in Suds | 12.9 |
| 3 | Dermasil in Suds | 9.4 |
| 4 | STL-7 in Suds | 8.5 |

We also wanted to see if this composition was effective at removing already set sunscreen stains. It is believed that the stains become much more difficult to remove once they have been set by the heat of drying, so this is a more difficult challenge than removing fresh sunscreen from linen as discussed above. To test this we created set stain swatches by coating swatches as before, but washed them this time with a combination of a larger amount of high alkalinity detergent coupled with sodium hypochlorite bleach. After this treatment the Δb* of the set stain swatches was 8.6 (I am not sure you mean the uncoated swatch value was 8.6 (Table 4). These stained swatches were then washed a second time using the normal wash procedure. With no added booster the amount of stain did not really change, giving a Δb* of 8.5 (Run #2). The commercially available booster Dermasil did slightly better when added in the flush step, giving a Δb* of 7.8 (Run #3), while the STL-7 detergency booster again gave the best results with a Δb* of 7.0 (Run #4).

TABLE 4

Boosters on Set Stains in Flush Step

| Run # | Sample | Δb* |
|---|---|---|
| 1 | Control—no Flush | 8.6 |
| 2 | Control with no booster | 8.5 |
| 3 | Dermasil in Flush | 7.8 |
| 4 | STL-7 in Flush | 7.0 |

Finally we wanted to test the effect of detergency boosters on sunscreen stains when used as pre-spotters (Table 5). Since fresh sunscreen stains are not visible until washed, in this case the test had to be run with set stains only. Each 2"×3" swatch was coated with sunscreen and washed to set the stain as above, then treated with 3 g of detergency booster and allowed to sit overnight before being washed a second time using the normal procedure. The set stain and control with no booster (Runs #1 and #2) are the same as before in Table 4. For Run #3 the swatches were treated with Stain Blaster A, a commercially available pre-spotter available from Ecolab, while for Run #4 the swatches were treated with STL-7. In this case the results were much better, giving Δb* values for both pre-spot treatments that were quite low, with essentially no visible yellow stain left. Again STL-7 gave the best performance, showing that this composition is not only effective at reducing fresh sunscreen stains when used as a flush, but also removing most of a set sunscreen stain when used as a pre-spotter.

TABLE 5

Boosters as Pre Spotters on Set Stains

| Run # | Sample | Δb* |
|---|---|---|
| 1 | Stain after Setting | 8.6 |
| 2 | Control with no booster | 8.5 |
| 3 | Stain Blaster A | 2.2 |
| 4 | STL-7 | 1.6 |

Commercial Detergent F is an NPE based detergent with 90.29% active surfactant and Commercial Detergent G is an NPE based detergent with 20% active surfactant and 39.63% active sodium hydroxide.

Wash Procedure

Conditions: Unimac #4 (35 lbs machine), 25 lbs cotton fills with 8 unwashed sunscreen coated swatches 1. Filled the machine with medium level of 5 grains water at 145° F. Then 5 oz of detergent booster from flush cup was supplied into the machine. Then washed for 10 minutes and drained 2 minutes afterward.

2. Filled the machine with medium level of 5 grains water at 145° F. Added 1 oz of Commercial Detergent F and varies amount of Builder to boost up the pH ~11. Both the Commercial Detergent F and Builder were added in the Suds step. Then washed for 20 minutes and 2 minutes drained. Note: Most of the time, pH ~11 with 45 g of Builder was added. The pH was adjusted with Builder to ensure it pursues pH ~11 before the actual wash.

3. Filled the machine with high level of 5 grains water at 145° F. Washed for 2 minutes and drained for 2 minutes. Next filled the machine with high level of 5 grains water at 145° F. and drained for 2 minutes. Finally filled the machine with high level of 5 grains water at 130° F., drained for 2 minutes, and extracted for 5 minutes with medium spinning.

Stain Setting Procedure

Conditions: Unimac #4 (35 lbs machine), 25 lbs cotton fills with 8 unwashed sunscreen coated swatches 1. Filled the machine with medium level of 5 grains water at 120° F. Then added 98 g Commercial Detergent G detergent from flush cup into the machine. Then washed for 7 minutes and drained 2 minutes afterward.

2. Filled the machine with high level of 5 grains water at 120° F. Then washed for 2 minutes and drained for 2 minutes. Afterward, filled the machine again with low level of 5 grains water at 120 F. Then added 28 g of Chlorine Bleach into the machine from cup 2 as a Suds step. Washed for 7 minutes and drained for 2 minutes.

3. Finally, filled the machine with high level of 5 grains water at 105° F. Washed for 2 minutes and drained for 2 minutes. Repeat step 3 three more times. Then extracted at 400 rpm for 5 minutes.

The extended chain surfactant solvent blend in combination with amine oxide proved superior to traditional detergents in removing sunscreen stains.

What is claimed is:

1. A cleaning composition for reducing stains caused by sunscreen components comprising:

about 50-70% by weight of an extended chain nonionic surfactant;

from about 10-40% of one or more solvents selected from the group consisting of butyl carbitol, propylene-glycol-phenyl-ether, polyethylene oxide ethers derived from lauryl alcohol, cetyl alcohol, oleyl alcohol, stearyl alcohol, isostearyl alcohol, myristyl alcohol, behenyl alcohol, and mixtures thereof; and about 1-15% amine oxide;

wherein said extended chain nonionic surfactant is of the formula:

$$R\text{-}[L]_x\text{-}[O\text{—}CH_2\text{-}CH_2]_y$$

where R is a linear or branched, saturated or unsaturated, substituted or unsubstituted aliphatic hydrocarbon radical having from about 6 to 20 carbon atoms, L is a propoxy group, x is the average degree of propoxylation ranging from 1-16, and y is the average degree of ethoxylation ranging from 1-14.

2. The booster cleaning composition of claim 1 wherein said solvent is butyl carbitol and/or propylene-glycol-phenyl-ether.

3. The booster cleaning composition of claim 1 further comprising an anionic surfactant.

4. The booster cleaning composition of claim 1 further including a chelant.

5. The booster cleaning composition of claim 1 wherein said composition reduces stains caused by avobenzone and oxybenzone.

6. A method for reducing stains caused by avobenzone and oxybenzone and other sunscreen components from fabric comprising:

treating said fabric with a booster cleaning composition of claim 1 and rinsing and/or wiping the cleaning composition from the fabric.

7. A cleaning composition or detergent comprising;

the booster composition of claim 1, a builder and an enzyme.

* * * * *